United States Patent [19]

Ishikawa et al.

[11] Patent Number: 5,002,860

[45] Date of Patent: Mar. 26, 1991

[54] METHOD FOR PROCESSING A SILVER HALIDE COLOR PHOTOGRAPHIC MATERIAL

[75] Inventors: Takatoshi Ishikawa; Toshio Kawagishi, both of Kanagawa, Japan

[73] Assignee: Fuji Photo Film Co., Ltd., Kanagawa, Japan

[21] Appl. No.: 313,279

[22] Filed: Feb. 21, 1989

[30] Foreign Application Priority Data

Feb. 19, 1988 [JP] Japan ..... 63-36553

[51] Int. Cl.[5] ..... G03C 7/00; G03C 7/26

[52] U.S. Cl. ..... 430/393; 430/430; 430/460; 430/558; 430/461

[58] Field of Search ..... 430/393, 430, 460, 461, 430/558

[56] References Cited

U.S. PATENT DOCUMENTS 4,818,664 4/1989 Ueda et al. ..... 430/393

4,842,994 6/1989 Sakanone et al. ..... 430/430

*Primary Examiner*—Charles L. Bowers, Jr.

*Assistant Examiner*—Thorl Chea

*Attorney, Agent, or Firm*—Sughrue, Mion, Zinn, Macpeak & Seas

[57] ABSTRACT

A novel process for processing a silver halide color photographic material is disclosed, which comprises color-developing a silver halide color photographic material which has been imagewise exposed to light, and then processing the silver halide color photographic material with a processing solution having a bleaching ability, wherein the silver halide color photographic material comprises at least one magenta coupler represented by formula (M-1) and the processing solution having a bleaching ability comprises as a bleaching agent (1) at least one of ferric complex salts of compounds selected from Compound Group (A) and (2) a ferric 1,3-diaminopropanetetraacetate complex salt in a molar proportion of the (1) to the (2) of 3 or less:

Compound Group (A)

A-1: Ethylenediaminetetraacetic acid

A-2: Diethylenetriaminepentaacetic acid

A-3: Cyclohexanediaminetetraacetic acid

A-4: 1,2-Propylenediaminetetraacetic acid (M-1)

wherein Za and Zb each represents —CH=, or =N—; $R_1$ and $R_2$ each represents a hydrogen atom or a substituent; and X represents a hydrogen atom or a group which is released upon a coupling reaction with an oxidation product of an aromatic primary amine developing agent, with the proviso that when Za=Zb is a carbon-carbon double bond, it is a portion of an aromatic ring.

9 Claims, No Drawings

METHOD FOR PROCESSING A SILVER HALIDE COLOR PHOTOGRAPHIC MATERIAL

FIELD OF THE INVENTION

The present invention relates to a method for processing a silver halide color photographic material which comprises developing a silver halide color photographic material which has been exposed to light, and then desilvering the silver halide color photographic material. More particularly, the present invention relates to an improved processing method which enables rapid bleaching and stabilization of images after processing.

BACKGROUND OF THE INVENTION

In general, the processing of a color light-sensitive material essentially consists of a color development process and a desilvering process. In particular, a silver halide color photographic material which has been imagewise exposed to light is subjected to a color development process where exposed silver halide is reduced by a color developing agent to produce silver. The resulting oxidized color developing agent reacts with a color coupler to produce a dye image. The color light-sensitive material is then desilvered wherein silver thus produced is oxidized by a bleaching agent and then dissolved and removed by a silver ion complexing agent commonly known as a fixing agent. Thus, the photographic material which has been subjected to these processes forms only dye images thereon. The practical development process comprises auxiliary processes for maintaining the photographic or physical qualities or for preserving the images besides the above-described two principal processes, i.e., color development and desilvering. Examples of baths used in these auxiliary processes include a film hardening bath for preventing excess softening of a light-sensitive layer during processing, a stop bath for effectively stopping the development reaction, an image stabilizing bath for stabilizing images, and a defilming bath for removing the backing layer.

The desilvering process may be effected either in a two-step process wherein a bleaching bath and a fixing bath are separately provided or in a non-step process wherein a blixing bath comprising a bleaching agent and a fixing agent is provided together to simplify or expedite the processing.

In recent years, color photographic light-sensitive materials have been commonly bleached with a ferric ion complex salt (e.g., aminopolycarboxylic acid ferric ion complex salt, and particularly ferric ethylenediaminetetraacetate complex salt) in order to shorten or simplify the processing and to prevent environmental pollution.

However, such a ferric ion complex salt is disadvantageous in that it has a relatively weak oxidizing power or an insufficient bleaching power. When such a bleaching agent is used to bleach or blix a slow speed silver halide color photographic material mainly comprising a silver bromochloride emulsion, the desired objectives are readily accomplished. However, when such a bleaching agent is used to process a color-sensitized high speed silver halide color photographic material mainly comprising a silver bromochloride or silver bromoiodide emulsion, and particularly color reversal or color negative materials comprising a high silver content emulsion, its insufficient bleaching power results in poor desilvering activity or a prolonged time for bleaching is thus required.

A color light-sensitive material normally uses a sensitizing dye for the purpose of color sensitization. Particularly, when high silver content grains or high aspect ratio tabular grains are used for higher sensitivity, a sensitizing dye adsorbed by the surface of silver halide impedes the bleaching of silver produced by development of the silver halide.

As a bleaching agent other than ferric ion complex salt, persulfate is well known. Persulfate is normally used as a bleaching solution comprising chloride. However, such persulfate bleaching solutions have even weaker bleaching power than ferric ion complex salts and thus require a remarkably prolonged time for bleaching.

In general, a nonpolluting bleaching agent or a bleaching agent which is not corrosive to machinery tends to have a weak bleaching power. It has therefore been desirable to enhance the bleaching ability of bleaching solutions or blixing solutions comprising a bleaching agent having a weak bleaching power, particularly that using a ferric ion complex salt or persulfate.

Processing methods using two or more ferric aminopolycarboxylate complex salts are described in *Research Disclosure,* No. 24023 (April, 1984), and JP-A-60-230653 (the term "JP-A" as used herein refers to a "published unexamined Japanese patent application"). However, these methods also leave much to be desired.

A ferric 1,3-diaminopropanetetraacetate complex is a bleaching agent having an excellent bleaching power which can be effectively used to shorten the desilvering process. However, a color-developed light-sensitive material is immediately processed with a bleaching solution comprising such a bleaching agent, resulting in a remarkable bleach fog. Accordingly, it has been desired to eliminate this problem.

On the other hand, examples of pyrazoloazole magenta couplers represented by formula (M-1) include couplers described in JP-A-59-162548, JP-A-60-43659, JP-A-59-171956, and JP-A-60-33552, and U.S. Pat. No. 3,061,432. Dyes formed from these couplers are particularly excellent. However, the use of such a coupler is disadvantageous in that a color developing agent tends to be left in the color photographic light-sensitive material following processing. In particular, when the process following the color development, i.e., desilvering, washing and/or stabilizing process is shortened, the light-sensitive material which has been thus processed tends to exhibit magenta stain (color intensification at the minimum magenta density portion). It has thus been desired to eliminate this problem.

SUMMARY OF THE INVENTION

Therefore, an object of the present invention is to simultaneously solve two problems caused by the shortening of desilvering time using a bleaching agent having an excellent bleaching power, i.e., the light-sensitive material thus processed tends to exhibit bleach fog and the rapid processing causes an increase in the amount of residual developing agent, making the light-sensitive material which has been thus processed more susceptible to stain.

The above and other objects of the present invention will become more apparent from the following detailed description and examples.

The objectives of the present invention are accomplished by a method for processing a silver halide color photographic material which comprises color-developing a silver halide color photographic material which has been imagewise exposed to light, and then processing said silver halide color photographic material with a processing solution having a bleaching ability, wherein said silver halide color photographic material comprises at least one magenta coupler represented by formula (M-1) and said processing solution having a bleaching ability comprises as a bleaching agent (1) at least one of ferric complex salts of compounds selected for the Compound Group (A) and a ferric 1,3-diaminopropanetetraacetate complex salt in a molar proportion of the (1) to the (2) of 3 or less:

Compound Group (A)

A-1: Ethylenediaminetetraacetic acid
A-2: Diethylenetriaminepentaacetic acid
A-3: Cyclohexanediaminetetraacetic acid
A-4: 1,2-Propylenediaminetetraacetic acid

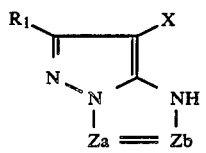

(M-1)

wherein Za and Zb each represents —CH=,

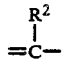

or =N—; $R_1$, and $R_2$ each represents a hydrogen atom or a substituent; and X represents a hydrogen atom or a group which is released upon a coupling reaction with an oxidation product of an aromatic primary amine developing agent, with the proviso that when Za=Zb is a carbon-carbon double bond, it is a portion of an aromatic ring.

DETAILED DESCRIPTION OF THE INVENTION

The present invention is based on the premise that the combined use of a ferric 1,3-diaminopropanetetraacetate complex and a ferric complex represented by Compound Group (A) minimizes the reduction in bleaching power and prevents bleach fog. Furthermore, the present invention is based on the unexpected discovery that a magenta coupler of formula (M-1) used with the above ferric complexes of the present invention reduces a bleach fog.

The combined use of the above-described ferric aminopolycarboxylate complexes resulted in the unexpected discovery that such a combination leads to reduction in the concentration of residual developing agent in a light-sensitive material which has been thus processed.

The processing bath having a bleaching ability of the present invention is further described below.

In the present invention, color development is immediately followed by processing in a processing bath having a bleaching capability.

A processing bath having a bleaching ability normally comprises a bleaching solution or a blixing solution. In the present invention, a bleaching solution is preferred because it has stronger bleaching ability. Examples of the present desilvering process are described hereinafter, but the present invention is not limited thereto.

(i) Bleaching - Fixing
(ii) Bleaching - Blixing
(iii) Blixing
(iv) Blixing - Blixing
(v) Bleaching - Washing - Fixing In order to attain the effects of the present invention, the processes (i) and (ii) are preferably used.

The present bleaching agent comprises (1) at least one ferric complex salt of a compound selected from the Compound Group (A) and (2) a ferric complex salt of 1,3-diaminopropanetetraacetate as the bleaching agent with the molar ratio of the former (i.e., (1)) to the latter (i.e., (2)) ranging 3 or less and preferably from 0.5 to 1.8. If the molar ratio exceeds 3, the bleaching ability of the processing bath is lowered thus causing poor desilvering. If the proportion of ferric salt of 1,3-diaminopropanetetraacetate is too high, slight bleach fog may result. In step (2), the bleaching agent added to the bleach-fixing is preferably at least one of ferric complex salts of the compounds selected from the foregoing Compound Group (A).

The amount of the present bleaching agent (i.e., (1) at least one ferric complex salt of a compound selected from the Compound Group (A) and (2) a ferric complex salt of 1,3-diaminopropanetetraacetate) to be incorporated in the bath having a bleaching ability is from 0.05 to 1 mol, preferably from 0.1 to 0.5 mol, per liter of the bath having a bleaching ability.

In addition to the above-described ferric complex of aminopolycarboxylic acid, a salt of aminopolycarboxylic acid may be incorporated into the present processing solution. In particular, a compound selected from the Compound Group (A) is preferably incorporated into the processing solution. The amount of Compound Group (A) to be incorporated is preferably in the range of from 0.0001 to 0.1 mol/liter, and particularly from 0.003 to 0.05 mol/liter.

The aminopolycarboxylic acid and its ferric complex salt is preferably used in the form of an alkali metal salt or ammonium salt. Particularly, an ammonium salt of the aminopolycarboxylic acid is preferably used because it has excellent solubility and strong bleaching ability.

The bleaching solution or blixing solution comprising the above-described ferric ion complex may comprise complex salts of metal ions other than iron, such as cobalt or copper.

The present bath having a bleaching ability may comprise various bleaching accelerators.

Bleaching accelerators for use in the present invention include compounds containing a mercapto group or disulfide group as described in U.S. Pat. No. 3,893,858, German Patent 1,290,812, British Patent 1,138,842, JP-A-53-95630, and Research Disclosure, No. 17129 (July, 1978); thiazolidine derivatives as described in JP-A-50-140129; thiourea derivatives as described in U.S. Pat. No. 3,706,561; iodides as described in JP-A-58-16235; polyethylene oxides as described in German Patent 2,748,430; or polyamine compounds as described in JP-B-45-8836 (the term "JP-B" as used herein refers to an "examined Japanese patent publication"). In particular, a mercapto compound as described in British Patent 1,138,842 is preferably used.

In the present invention, the bleaching accelerators represented by formulae (I A) to (VI A) are preferably used because they have strong bleaching ability and cause little bleach fog.

$$R^{1A}—S—M^{1A} \quad \text{(I A)}$$

wherein $M^{1A}$ represents a hydrogen atom, an alkali metal atom or ammonium; and $R^{1A}$ represents an alkyl group, an alkylene group, an aryl group or a heterocyclic residual group. The alkyl group represented by $R^{1A}$ has preferably from 1 to 5 carbon atoms and particularly from 1 to 3 carbon atoms. The alkylene group represented by $R^{1A}$ preferably has from 2 to 5 carbon atoms. Examples of the aryl group represented by $R^{1A}$ include a phenyl group and a naphthyl group. A phenyl group is preferably used. Preferred examples of the heterocyclic residual group represented by $R^{1A}$ include nitrogen-containing 6-membered rings such as pyridine and triazine, and nitrogen-containing 5-membered rings such as azole, pyrazole, triazole, and thiadiazole. Among these compounds, a compound wherein two or more of the ring members are nitrogen are particularly preferred. $R^{1A}$ may be substituted by substituent groups including an alkyl group, an alkylene group, an alkoxy group, and aryl group, a carboxy group, a sulfo group, an amino group, an alkylamino group, a dialkylamino group, a hydroxy group, a carbamoyl group, a sulfanoyl group, and a sulfonamide group.

Among the compounds of formula (I A), preferred compounds are represented by formulae (I A-1) to (I A-4).

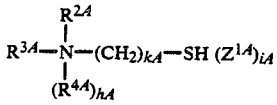

(I A-1)

wherein $R^{2A}$, $R^{3A}$ and $R^{4A}$ may be the same or different and each represents a hydrogen atom, a substituted or unsubstituted lower alkyl group (preferably a lower alkyl group having from 1 to 5 carbon atoms, particularly methyl, ethyl, propyl), or an acyl group (preferably an acyl group having from 1 to 3 carbon atoms, particularly acetyl, propionyl); kA represents an integer of from 1 to 3; $Z^{1A}$ represents an anion (e.g., chlorine ion, bromine ion, sulfuric acid ion, nitric acid ion, p-toluenesulfonate, oxalate); hA represents an integer of 0 or 1; and iA represents an integer of 0 or 1.

$R^{2A}$ and $R^{3A}$ may be connected to each other to form a ring. $R^{2A}$, $R^{3A}$ and $R^{4A}$ each may be a hydrogen atom or a substituted or unsubstituted lower alkyl group.

The substituents which may be contained in $R^{2A}$, $R^{3A}$ and $R^{4A}$ and are preferably a hydroxy group, a carboxy group, a sulfo group or an amino group.

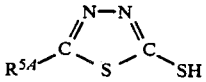

(I A-2)

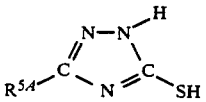

(I A-3)

-continued

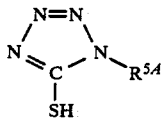

(I A-4)

wherein $R^{5A}$ represents hydrogen, a halogen atom (e.g., chlorine, bromine), an amino group, a substituted or unsubstituted lower alkyl group (e.g., preferably a lower alkyl group having from 1 to 5 carbon atoms, particularly methyl, ethyl, propyl), an amino group containing an alkyl group (e.g., preferably methylamino, ethylamino, dimethylamino, diethylamino) or a substituted or unsubstituted alkylthio group.

Examples of the substituent which may be contained in $R^{5A}$ include a hydroxy group, a carboxy group, a sulfo group, an amino group, and an amino group containing an alkyl group.

$$R^{1A}—S—S—R^{6A} \quad \text{(II A)}$$

wherein $R^{1A}$ has the same meaning as $R^{1A}$ in formula (I A); and $R^{6A}$ has the same meaning as $R^{1A}$ in formula (I A). $R^{1A}$ and $R^{6A}$ may be the same or different.

Among the compounds represented by formula (II A), preferred compounds are represented by formula (II A-1):

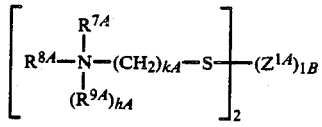

(II A-1)

wherein $R^{7A}$, $R^{8A}$ and $R^{9A}$ have the same meaning as Rhu 2A, $R^{3A}$ and $R^{4A}$, respectively; hA, kA and $Z^{1A}$ have the same meaning as hA, kA and $Z^{1A}$ in formula (I A-1); and iB represents an integer of 0, 1 or 2.

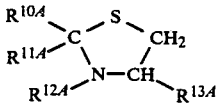

(III A)

wherein $R^{10A}$ and $R^{11A}$ may be the same or different and each represents hydrogen, an alkyl group which may contain a substituent (preferably a lower alkyl group, e.g., methyl, ethyl, propyl), a phenyl group which may contain a substituent, or a heterocyclic residual group which may contain a substituent (particularly, a heterocyclic group containing at least one hetero atom selected from nitrogen, oxygen, and sulfur, e.g., a pyridine ring, a thiophene ring, a thiazolidine ring, a benzoxazole ring, a benzotriazole ring, a thiazole ring, an imidazole ring); and $R^{12A}$ represents hydrogen or a lower alkyl group which may contain a substituent (preferably a lower alkyl group having from 1 to 3 carbon atoms, e.g., methyl, ethyl).

Examples of the substituent which may be contained in $R^{10A}$ to $R^{12A}$ include a hydroxy group, a carboxy group, a sulfo group, an amino group, and a lower alkyl group.

$R^{13A}$ represents hydrogen, an alkyl group or a carboxy group.

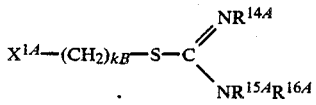

(IV A)

wherein $R^{14A}$, $R^{15A}$ and $R^{16A}$ may be the same or different and each represents hydrogen or a lower alkyl group (preferably a lower alkyl group having from 1 to 3 carbon atoms, e.g., methyl, ethyl); and kB represents an integer of 1 to 5.

$X^{1A}$ represents an amino group which may be substituted, a sulfo group, a hydroxy group, a carboxy group or hydrogen. Examples of such a substituent include substituted or unsubstituted alkyl groups (e.g., methyl, ethyl, hydroxyalkyl, alkoxyalkyl, carboxyalkyl]. These two alkyl groups may form a ring.

$R^{14A}$, $R^{15A}$ and $R^{16A}$ may be connected to each other to form a ring. $R^{14A}$, $R^{15A}$ and $R^{16A}$ each preferably represents a hydrogen atom, a methyl group or an ethyl group. $X^{1A}$ preferably represents an amino group or a dialkylamino group.

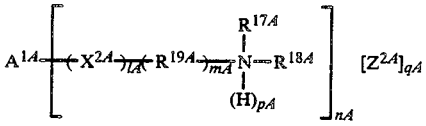

(V A)

wherein $A^{1A}$ represents an aliphatic connecting group, an aromatic connecting group or a heterocyclic connecting group having a valency of n (when n is 1, $A^{1A}$ represents a mere aliphatic group, aromatic group or heterocyclic group).

Examples of the aliphatic connecting group represented by $A^{1A}$ include an alkylene group having from 3 to 12 carbon atoms (e.g., trimethylene, hexamethylene, cyclohexylene).

Examples of the aromatic connecting group represented by $A^{1A}$ include an arylene group having from 6 to 18 carbon atoms (e.g., phenylene, naphthylene).

Examples of the heterocyclic connecting group represented by $A^{1A}$ include a heterocyclic group comprising one or more hetero atoms (e.g., oxygen, sulfur, and nitrogen) such as thiophene, furan, triazine, pyridine, and piperidine.

Normally, there is one aliphatic connecting group, aromatic connecting group or heterocyclic connecting group. Two or more connecting groups may be connected directly or through a divalent connecting group (e.g., —0—, —S—,

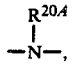

$—SO_2—$, —CO— or connecting group formed of these connecting groups in which $R^{20A}$ represents a lower alkyl group).

These aliphatic connecting groups, aromatic connecting groups and heterocyclic connecting groups may contain a substituent.

Examples of such a substituent include an alkoxy group, a halogen atom, an alkyl group, a hydroxy group, a carboxy group, a sulfo group, a sulfonamide group, and a sulfamide group.

$X^{2A}$ represents —0—, —S—, or

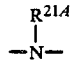

in which $R^{21A}$ represents a lower alkyl group (e.g., methyl, ethyl). $R^{17A}$ and $R^{18A}$ each represents a substituted or unsubstituted lower alkyl group (e.g., methyl, ethyl, propyl, isopropyl, pentyl). Preferred examples of such a substituent include a hydroxy group, a lower alkyl group (e.g., methoxy, methoxyethoxy, hydroxyethoxy), and an amino group (e.g., unsubstituted amino, dimethylamino, N-hydroxyethyl-N-methylamino). If there are two or more substituents, they may be the same or different.

$R^{19A}$ represents a lower alkylene group having from 1 to 5 carbon atoms (e.g., methylene, ethylene, trimethylene, methylmethylene). $Z^{2A}$ represents an anion (e.g., halide ion such as chlorine ion, bromine ion, nitric acid ion, sulfuric acid ion, p-toluenesulfonate, oxalate).

$R^{17A}$ and $R^{18A}$ may be connected to each other via a carbon atom or a hetero atom selected from oxygen, nitrogen, and sulfur) to form a 5- or 6-membered heterocyclic group (e.g., a pyrrolidine ring, a piperidine ring, a morpholine ring, a triazine ring, an imidazolidine ring).

$R^{17A}$ or $R^{18A}$ and $A^{1A}$ may be connected to each other via a carbon atom or a hetero atom (e.g., oxygen, nitrogen, and sulfur) to form a 5- or 6-membered heterocyclic group (e.g., a hydroxyquinoline ring, a hydroxyindole ring, an isoindoline ring).

$R^{17A}$ or $R^{18A}$ and $R^{19A}$ may be connected to each other via a carbon atom or a hetero atom (e.g., oxygen, nitrogen, and sulfur) to form a 5- or 6-membered heterocyclic group (e.g., a piperidine ring, a pyrrolidine ring, a morpholine ring).

The suffix lA represents an integer of 0 or 1, mA represents an integer of 0 or 1, nA represents an integer of 1, 2 or 3, pA represents an integer of 0 or 1, and qA represents an integer of 0, 1, 2 or 3.

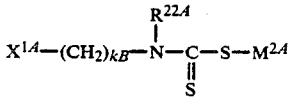

(VI A)

wherein $X^{1A}$ and kB have the same meaning as $X^{1A}$ and kB in formula (IV A). $M^{2A}$ represents hydrogen, an alkali metal atom, ammonium or

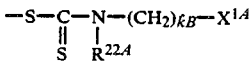

in which $R^{22A}$ represents hydrogen or a lower alkyl group (e.g., a lower alkyl group having from 1 to 5 carbon atoms which may be substituted).

Specific examples of the compounds represented by formulae (I A) to (VI A) are shown as follows.

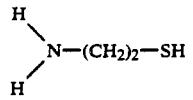
(IA)-(1)
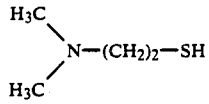
(IA)-(2)
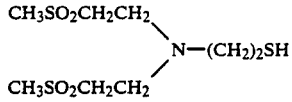
(IA)-(3)
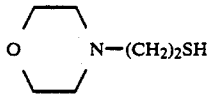
(IA)-(4)
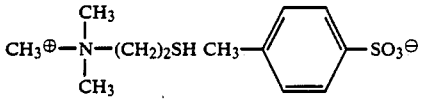
(IA)-(5)
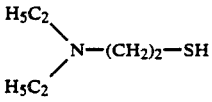
(IA)-(6)
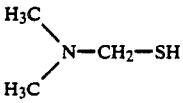
(IA)-(7)
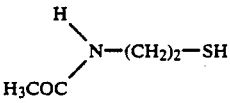
(IA)-(8)
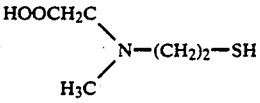
(IA)-(9)
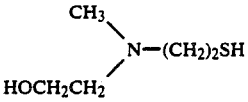
(IA)-(10)
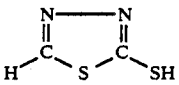
(IA)-(11)
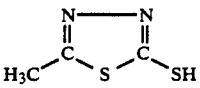
(IA)-(12)
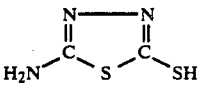
(IA)-(13)
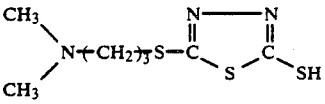
(IA)-(14)

-continued
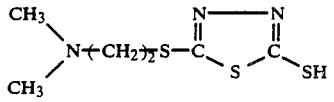
(IA)-(15)
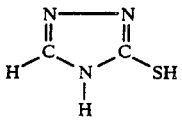
(IA)-(16)
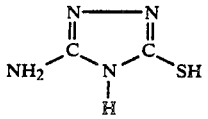
(IA)-(17)
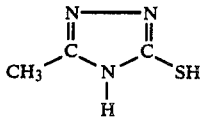
(IA)-(18)
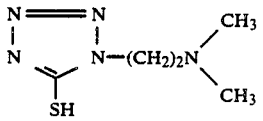
(IA)-(19)
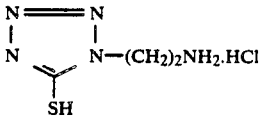
(IA)-(20)
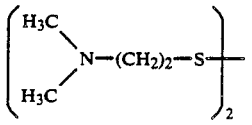
(IIA)-(1)
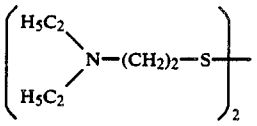
(IIA)-(2)
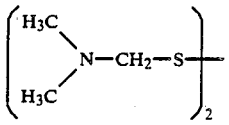
(IIA)-(3)
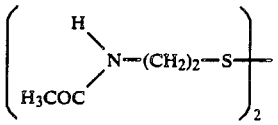
(IIA)-(4)
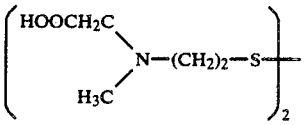
(IIA)-(5)

-continued
(IIA)-(6)
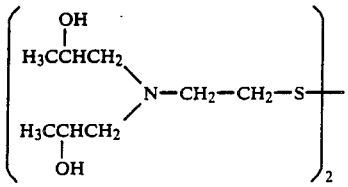
(IIA)-(7)
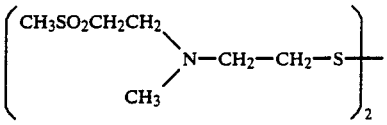
(IIA)-(8)
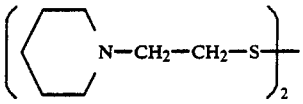
(IIA)-(9)
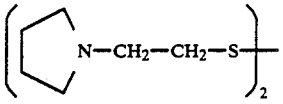
(IIA)-(10)
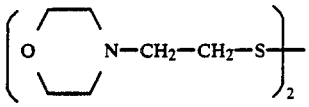
(IIA)-(11)
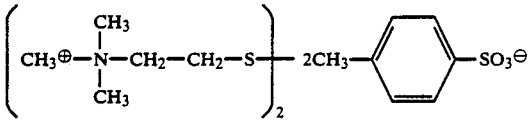
(IIA)-(12)
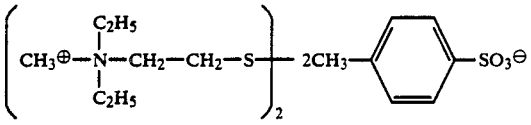
(IIIA)-(1)
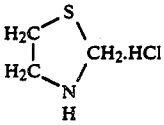
(IIIA)-(2)
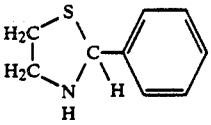
(IIIA)-(3)
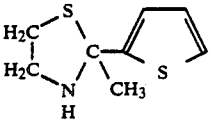
(IIIA)-(4)
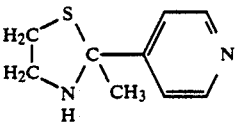

-continued
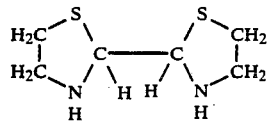
(IIIA)-(5)
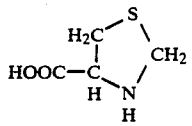
(IIIA)-(6)
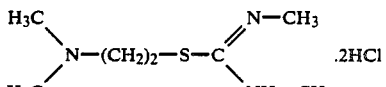
(IVA)-(1)
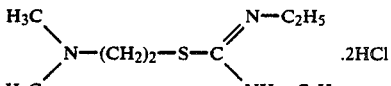
(IVA)-(2)
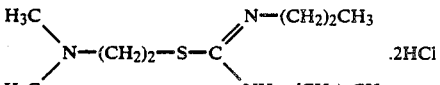
(IVA)-(3)
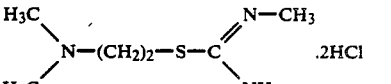
(IVA)-(4)
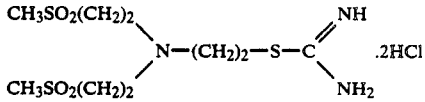
(IVA)-(5)
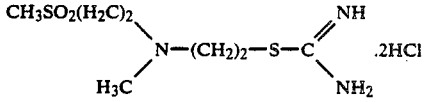
(IVA)-(6)
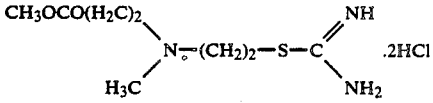
(IVA)-(7)
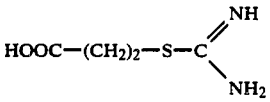
(IVA)-(8)
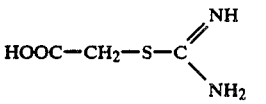
(IVA)-(9)
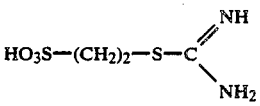
(IVA)-(10)
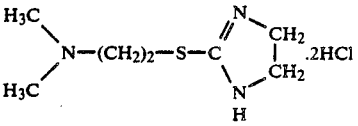
(IVA)-(11)

-continued
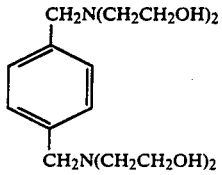
(VA)-(1)
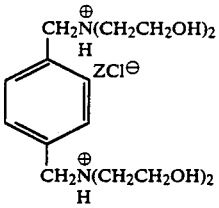
(VA)-(3)
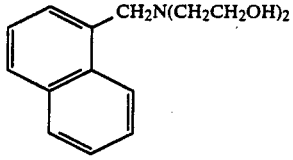
(VA)-(4)
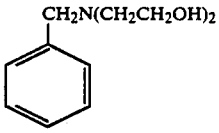
(VA)-(5)
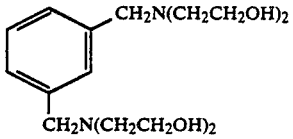
(VA)-(6)
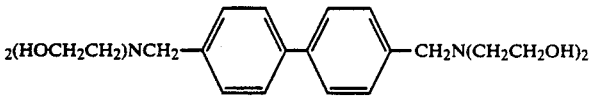
(VA)-(7)
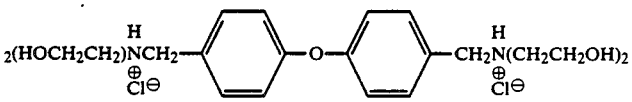
(VA)-(8)
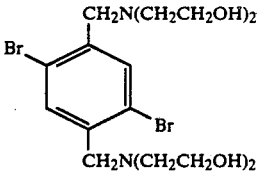
(VA)-(9)
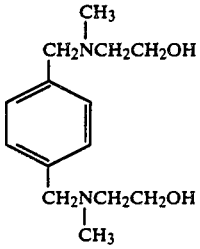

-continued
(VA)-(10)
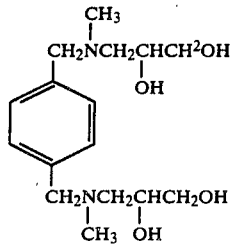
(VA)-(11)
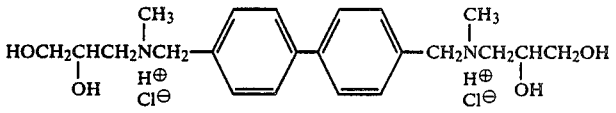
(VA)-(12)
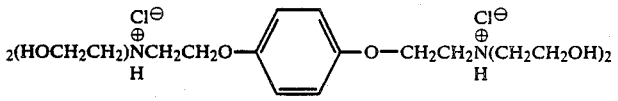
(VA)-(13)
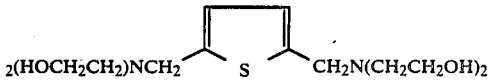
(VA)-(14)
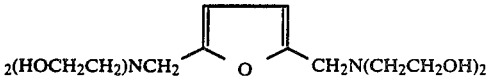
(VA)-(15)
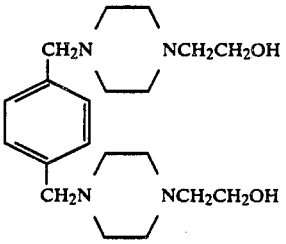
(VA)-(16)
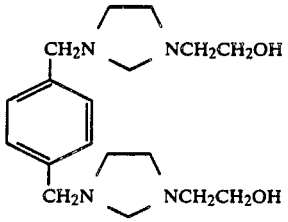
(VA)-(17)
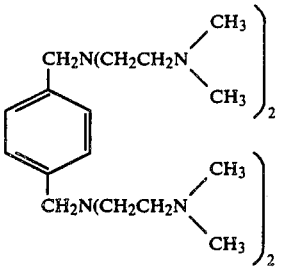
(VA)-(18)
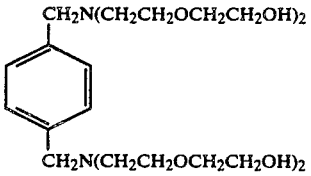

-continued
(VA)-(19)
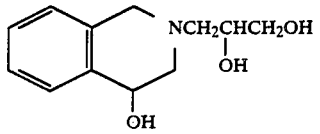
(VA)-(20)
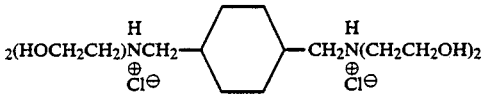
(VA)-(21)
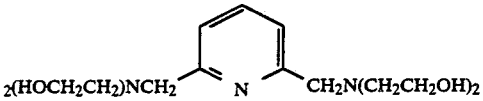
(VA)-(22)
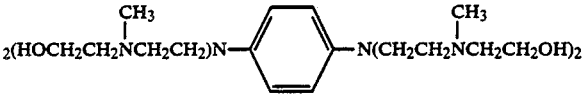
(VA)-(23)
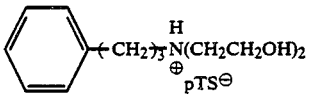
(VA)-(24)
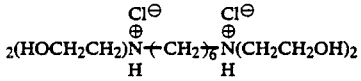
(VA)-(25)
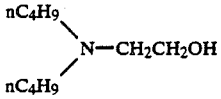
(VA)-(26)
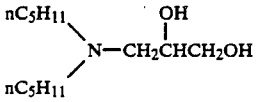
(VIA)-(1)
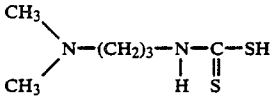
(VIA)-(2)
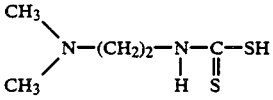
(VIA)-(3)
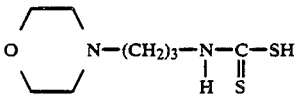
(VIA)-(4)
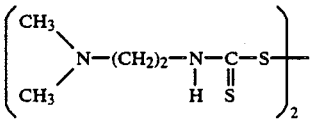
(VIA)-(5)
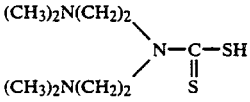
Particularly preferred compounds among these bleaching accelerators are (I A)-(2), (I A)-(5), (I A)-(13), (I A)-(14), (I A)-(15), (I A)-(16), (I A)-(19), (II A)-(1), (II A)-(11), (V A)-(1), (VI A)-(1) and (VI A)-(2).

The amount of the bleaching accelerator to be incorporated is in the range of from 0.01 to 20 g, and preferably 0.1 g to 10 g, per liter of a bath having a bleaching ability.

In addition to the bleaching agent and the bleaching accelerators described above, the bleaching solution according to the present invention can contain rehalogenating agents, for example, bromides such as potassium bromide, sodium bromide and ammonium bromide and chlorides such as potassium chloride, sodium chloride and ammonium chloride. The amount of the rehalogenating agent is generally from 0.1 to 5 mol, preferably from 0.5 to 3 mol, per liter of the bleaching solution.

Further, other additives that have a pH buffering ability and are known to be used generally in a bleaching solution can be employed. For example, one or more inorganic acids, organic acids and their salts such as nitrates (e.g., sodium nitrate and ammonium nitrate), boric acid, borax, sodium metaborate, acetic acid, sodium acetate, sodium carbonate, potassium carbonate, phosphorous acids, phosphoric acid, sodium phosphate, citric acid, sodium citrate and tartaric acid can be added to the solution.

The pH value of the bath of the present invention having a bleaching ability is normally in the range of 1 to 6, preferably 1.5 to 5.8, and particularly 2 to 5.3. In the preferred pH range, the processing bath causes little bleach fog and exhibits an excellent desilvering property.

The replenished amount of the present processing solution having a bleaching ability is in the range of 50 to 2,000 ml and preferably 100 to 1,000 ml per 1 $m^2$ of the light-sensitive material.

In the present invention, the light-sensitive material which has been processed in a bath having a bleaching ability is normally processed in a bath having a fixing ability. However, this does not apply to the case where the bath having a bleaching ability is a blixing solution (i.e., a bleach-fixing solution).

The term "bath having a fixing ability" as used herein means a blixing bath or fixing bath.

Further, in the bleach-fixing (blixing) solution, thiosulfates such as sodium thiosulfate, ammonium thiosulfate, sodium ammonium thiosulfate and potassium thiosulfate; thiocyanates such as sodium thiocyanate, ammonium thiocyanate and potassium thiocyanate; thiourea; and thioethers are employed as fixing agents. The amount of the fixing agents used is generally from 0.3 to 3 mol and preferably from 0.5 to 2 mol per liter of the bleach-fixing solution (blixing solution).

The bleach-fixing (blixing) bath can contain preservatives such as sulfites (e.g., sodium sulfite, potassium sulfite and ammonium sulfite), hydroxylamines, hydrazines and aldehyde compound-bisulfite adducts (e.g., acetaldehyde-sodium bisulfite adduct). Further, various fluorescent brightening agents, defoaming agents, surface active agents, polyvinyl pyrrolidone, and organic solvents (e.g., methanol) may be added to the bleachfixing (blixing) bath. As such a preservative, there may be preferably used a sulfinic acid compound as described in JP-A-62-143048.

The amount of replenishment for the bleachfixing (blixing) bath is preferably from 300 to 3,000 ml and more preferably from 300 to 1,000 ml per $m^2$ of the color light-sensitive material.

The present processing bath having a fixing ability may preferably comprise various aminopolycarboxylic acids or organic phosphonic acids for the purpose of stabilizing the solution.

The shorter the total time of the present desilvering process is, the more remarkably is the effect of the present invention. The total time of desilvering process is preferably in the range of 1 to 4 minutes, particularly 1 minute and 30 seconds to 3 minutes. The processing temperature is in the range of 25 to 50° C., preferably 35 to 45° C. In the preferred processing temperature range, the desilvering rate can be improved, and stain after processing can be effectively prevented.

In the present desilvering process, agitation is preferably intensified as much as possible to attain the effects of the present invention more effectively.

Specific examples of methods for intensifying agitation include method as described in JP-A-62-184360 and JP-A-62-183461 which comprises spraying a processing solution against the emulsion surface of a lightsensitive material, method as described in JP-A-62-183461 which comprises using a rotating means to improve the agitating effect, method which comprises moving a lightsensitive material while keeping a wiper blade provided in the solution and the emulsion surface of the lightsensitive material in contact with each other to cause turbulence on the emulsion surface so that the agitating effect can be improved, and method which comprises increasing the circulating amount of the entire processing solution. Such an agitation improving means can be effectively used also in any of bleaching solution, blixing solution and fixing solution. It can be believed that the improvement of agitation expedites the supply of a bleaching agent, fixing agent and the like into the emulsion film, resulting in an improvement in the desilvering rate.

The above-described agitation improving means can be more effectively used in the case where a bleaching accelerator is used. The agitation improving means can drastically strengthen the bleach accelerating effect or eliminate the fixation inhibiting effect of the bleaching accelerator.

The automatic developing machine to be used in the present invention may preferably be provided with a light-sensitive material conveying means as described in JP-A-60-191257, JP-A-60-191258 and JP-A-60-191259. As described in JP-A-60-191257, such a conveying means can drastically reduce the amount of a processing solution carried over from prebath, thus preventing the deterioration in the properties of the processing solution. Such an effect is particularly effective for the reduction of the processing time at each step or the reduction of the supply amount of each processing solution.

The color developing solution used in the present invention contains a known aromatic primary amine color developing agent. Preferred examples thereof are p-phenylenediamine derivatives. Typical examples of the p-phenylenediamine derivative used are set forth below, but the present invention should not be construed as being limited thereto.

D- 1: N,N-Diethyl-p-phenylenediamine
D- 2: 2-Amino-5-diethylaminotoluene
D- 3: 2-Amino-5-(N-ethyl-N-laurylamino)toluene
D- 4: 4-[N-Ethyl-N-(β-hydroxyethyl)amino]aniline
D- 5: 2-Methyl-4-[N-ethyl]-N-(β-hydroxyethyl)amino] aniline
D- 6: 4-Amino-3-methyl-N-ethyl-N-[β-(methanesulfonamido)ethyl]aniline
D- 7: N-(2-Amino-5-diethylaminophenylethyl)methanesulfonamide D- 8 N,N-Dimethyl-p-phenylenediamine D- 9: 4-Amino-3-methyl-N-ethyl-N-methoxyethylaniline D-10: 4-Amino-3-methyl-N-ethyl-N-β-ethoxyethylaniline D-11: 4-Amino-3-methyl-N-ethyl-N-β-butoxyethylaniline Of these p-phenylenediamine derivatives, D-5 is particularly preferred.

These p-phenylenediamine derivatives may be in the form of salts such as sulfates, hydrochlorides, sulfites, or p-toluenesulfonates.

The aromatic primary amine developing agent is preferably used in an amount of generally from about 0.1 g to about 20 g and more preferably from about 0.5 g to about 10 g per liter of the developing solution.

Also, the color developing solution used in the present invention may contain, if desired, sulfites such as sodium sulfite, potassium sulfite, sodium bisulfite, potassium bisulfite, sodium metasulfite, and potassium metasulfite, or carbonyl-sulfite adducts, as preservatives.

The color developing solution contains the preservatives in an amount of 0.5 g to 10 g and more preferably 1 g to 5 g per liter of the color developing solution.

Further, it is preferred to add, as compounds capable of directly preserving the color developing agent, various hydroxylamines, hydroxamic acids as described in JP-A-63-43138, hydrazines and hydrazides as described in European Patent 254280A, phenols as described in JP-A-63-44657 and JP-A-63-58443, α-hydroxyketones and α-aminoketones as described in JP-A-63-44656, and/or various saccharides as described in JP-A-63-36244 to the color developing solution. Moreover, together with the above-described compounds, monoamines as described in JP-A-63-4235, JP-A-63-24254, JP-A-63-21647, JP-A-63-146040, JP-A-63-27841 and JP-A-63-25654; diamine as described in JP-A-63-30845, JP-A-63-146040 and JP-A63-43139; polyamines as described in JP-A-63-21647 and JP-A-63-26655; polyamines as described in JP-A-63-44655, nitroxy radicals as described in JP-A-63-53551; alcohols as described in JP-A-63-43140 and JP-A-63-53549; oximes as described in JP-A-63-56654; and tertiary amines as described in European Patent 266,797 are preferably employed.

Other preservatives such as various metals as described in JP-A-57-44148 and JP-A-57-53749, salicylic acids as described in JP-A-59-180588, alkanolamines as described in JP-A-54-3532, polyethyleneimines as described in JP-A-56-94349, aromatic polyhydroxyl compounds as described in U.S. Pat. No. 3,746,544, etc., may be incorporated into the color developing solution, if desired. Particularly, the addition of aromatic polyhydroxy compounds is preferred.

The color developing solution used in the present invention has a pH which ranges preferably from 9 to 12 and more preferably from 9 to 11.0. The color developing solution may also contain any of the compounds that are known to be usable as components of conventional developing solutions.

In order to maintain the pH within the abovedescribed range, various kinds of buffers are preferably employed. Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). The present invention should not be construed as being limited to these compounds.

The amount of the buffer to be added to the color developing solution is preferably 0.1 mol or more and more preferably from 0.1 mol to 0.4 mol per liter of the developing solution.

In addition, various chelating agents can be used in the color developing solution according to the present invention for the purpose of preventing calcium or magnesium precipitation or increasing the stability of the color developing solution.

As the chelating agents, organic acid compounds are preferred and include aminopolycarboxylic acids, organic phosphoric acids and phosphonocarboxylic acids.

Specific examples of useful chelating agents are set forth below, but the present invention should not be construed as being limited thereto.

Nitrilotriacetic acid
Diethylenetriaminepentaacetic acid
Ethylenediaminetetraacetic acid
N,N,N-Trimethylenephosphonic acid
Ethylenediamine-N,N,N',N'-tetramethylenephosphonic acid
trans-Cyclohexanediaminetetraacetic acid
1,2-Diaminopropanetetraacetic acid
Hydroxyethyliminodiacetic acid
Glycol ether diaminetetraacetic acid
Ethylenediamine-o-hydroxyphenylacetic acid
2-Phosphonobutane-1,2,4-tricarboxylic acid
1-Hydroxyethylidene-1,1-diphosphonic acid
N,N'-Bis(2-hydroxybenzyl) ethylenediamine-N,N'-diacetic acid Two or more kinds of such chelating agents may be employed together, if desired.

The chelating agent is added to the color developing solution in an amount sufficient to block metal ions being present therein. For example, a range of from about 0.1 g to about 10 g per liter of the color developing solution may be employed.

The color developing solution may contain appropriate development accelerators, if desired. However, it is preferred that the color developing solution used in the present invention does not substantially contain benzyl alcohol in view of prevention of environmental pollution, the easy preparation of the solution and prevention of color stain. The term "substantially not contain" means that the color developing solution contains benzyl alcohol in an amount of 2 ml or less per liter of the solution, and preferably does not contain benzyl alcohol at all.

Examples of suitable development accelerators include thioether type compounds as described in JP-B-37-16088, JP-B-37-5987, JP-B-38-7826, JP-B-44-12380, JP-B-45-9019 and U.S. Pat. No. 3,813,247; p-phenylenediamine type compounds as described in JP-A-52-49829 and JP-A-50-15554; quaternary ammonium salts as described in JP-A-50-137726, JP-B-44-30074, JP-A-56-156826 and JP-A-52-43429; amine type compounds as described in U.S. Pat. Nos. 2,494,903, 3,128,182, 4,230,796, 3,253,919, 2,482,546, 2,596,926 and 3,582,346, and JP-B-41-11431; polyalkylene oxides as described in JP-B-37-16088, JP-B-42-25201, JP-B-41-11431, JP-B-42-23883, and U.S. Pat. Nos. 3,128,183 and 3,532,501; 1-phenyl-3-pyrazolidones; and imidazoles.

The color developing solution used in the present invention may contain appropriate antifoggants, if desired. Alkali metal halides such as sodium chloride, potassium bromide, and potassium iodide as well as organic antifoggants may be employed as antifoggants. Representative examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine, etc.

It is preferred that the color developing solution used in the present invention contains a fluorescent brightening agent. As fluorescent brightening agents, 4,4'-diamino-2,2'-disulfostilbene type compounds are preferred. The amount of the fluorescent brightening agent added is from 0 to 5 g and preferably from 0.1 g to 4 g per liter of the color developing solution.

Furthermore, the color developing solution according to the present invention may contain various surface active agents such as alkylsulfonic acids, arylphosphonic acids, aliphatic carboxylic acids, and aromatic carboxylic acids, etc., if desired.

The processing temperature of the color developing solution used in the present invention is usually from 20° C. to 50° C. and preferably from 30° C. to 45° C. The processing time is usually from 20 seconds to 5 minutes and preferably from 30 seconds to 3 minutes. Further, the amount of replenishment for the color developing solution is preferably as small as feasible, and is usually from 100 ml to 1,500 ml, preferably from 100 ml to 800 ml, and more preferably from 100 ml to 400 ml, per square meter of the color light-sensitive material.

If required, the color developing bath may be divided into two or more baths, so that a color developing replenisher may be supplied from the first bath or the last bath to shorten the developing time or to reduce the amount of the replenisher.

The processing method according to the present invention can be used in a color reversal process. A suitable black-and-white developing solution used in this case includes a black-and-white first developing solution (used in reversal process of color photographic light-sensitive materials), or one that can be used in processing black-and-white photographic light-sensitive materials. Further, known various additives that are generally added to a black-and-white developing solution can be contained in the solution.

Representative additives include developing agents such as 1-phenyl-3-pyrazolidone, Metol ($HOC_6H_4NHCH_3.1/2H_2SO_4$) and hydroquinone; preservatives such as sulfites; accelerators comprising an alkali such as sodium hydroxide, sodium carbonate and potassium carbonate; inorganic or organic restrainers such as potassium bromide, 2-methylbenzimidazole and methylbenzothiazole; hard water softening agents such as polyphosphates; and development restrainers comprising trace amounts of iodides or mercapto compounds.

The processing method according to the present invention comprises processing steps including color development, bleaching, bleach-fixing (blixing), fixing, etc., as mentioned above. After the bleach-fixing (blixing) or fixing step, although processing steps that include water washing and stabilizing are generally carried out, a simple processing method is also possible wherein after being processed in a bath having a fixing ability, a stabilizing process is carried out without performing substantial water washing.

The washing water used in the water washing step can contain, if desired, known additives. For example, hard water softening agents such as inorganic phosphoric acid, aminopolycarboxylic acids and organic phosphoric acids, antibacterial and antifungal agents for preventing various bacteria and algae from proliferating (e.g., isothiazolone, organic chlorine type disinfectants and benzotriazole) and surface active agents for lowering drying load or for preventing uneven drying can be used. Compounds described, for example, in L. E. West, "Water Quality Criteria", *Phot. Sci. and Eng.*, Vol. 9, No. 6, pages 344 to 359 (1965) can also be used.

A suitable stabilizing solution used in the stabilizing step includes a processing solution for stabilizing dye images. For example, a solution having a pH of from 3 to 6 and a buffering ability and a solution containing an aldehyde (e.g., formalin) can be used. The stabilizing solution can contain, if desired, ammonium compounds, compounds containing metals such as Bi and Al, fluorescent brightening agents, chelating agents (e.g., 1-hydroxyethylidene-1,1-diphosphonic acid), antibacterial, antifungal agents, hardening agents, surface active agents, etc.

It is preferred to employ a multistage countercurrent system in the water washing step or stabilizing step. Two to four stages are preferably used. The amount of replenishment is from 1 to 50 times, preferably from 2 to 30 times, and more preferably from 2 to 15 times, the amount of processing solution carried over from the preceding bath per a unit area of the color light-sensitive material.

Water suitable for use in the water washing step or the stabilizing step includes city (tap) water, water that has been deionized, for example, by ion exchange resins to reduce Ca and Mg concentrations to 5 mg/liter or below, or water that has been sterilized, for example, by a halogen lamp or a bactericidal ultraviolet lamp.

When continuous processing is performed using an automatic developing machine, concentration of the processing solution tends to occur by evaporation in each step of the processing of color light-sensitive materials. This phenomenon particularly occurs in a case wherein a small amount of color light-sensitive materials is processed or wherein an open area of the processing solution is large. In order to compensate for such concentration of processing solution, it is preferred to replenish them with an appropriate amount of water or a correcting solution.

The overflow solution from the water washing step or stabilizing step may be flown into a prebath having a fixing ability to reduce the amount of waste liquor.

The silver halide color photographic material to be used in the present invention will be described hereinafter.

As silver halide to be incorporated in the photographic emulsion layer in the photographic lightsensitive material to be used in the present invention, there may be used silver chloride, silver bromide, silver bromochloride, silver chloroiodide, silver bromochloroiodide, or silver bromoiodide.

In order to attain the effects of the present invention, silver bromoiodide having a silver iodide content of 1 to 20 mol% may be particularly preferably used.

In the color light-sensitive materials processed in accordance with the present invention, any of silver bromide, silver iodobromide, silver iodochlorobromide, silver chlorobromide and silver chloride can be employed as silver halide. Silver halide containing at least 1 mol% of silver iodide is preferably employed.

The silver halide grains in the photographic emulsion may be so-called regular grains having a regular crystal form such as a cubic, octahedral or tetradecahedral structure, or may have an irregular crystal form such as a spherical crystal, a crystal defect such as a twin plane, or composite structure thereof.

The silver halide may be fine grains having a grain diameter of up to about 0.1 μm or coarse grains wherein the diameter of the projected area is up to about 10 μm, and a monodispersed emulsion having a narrow distribution or a polydispersed emulsion having a wide distribution can be used.

The silver halide photographic emulsion for use in the present invention may be prepared by methods described in *Research Disclosure,* Nos. 17643 (December, 1978), pp. 22–23, *I. Emulsion Preparation and Types,* and 18716 (November, 1979), page 648; P. Glafkides, *Chimic et Physique Photographique,* Paul Montel (1967); G. F. Duffin, *Photographic Emulsion Chemistry,* Focal Press (1966); V. L. Zelikman et al., *Making and Coating Photographic Emulsion,* Focal Press (1964).

A monodispersed emulsion as described in U.S. Pat. Nos. 3,574,628 and 3,655,394, and British Patent 1,413,748 is preferably used.

Alternatively, tabular grains having an aspect ratio of about 5 or more may be used in the present invention. Such tabular grains can be easily prepared by the method described in Gutoff, *Photographic Science and Engineering,* Vol. 14, pp. 248-257 (1970), U.S. Pat. Nos. 4,434,226, 4,414,310, 4,433,048 and 4,439,520, and British Patent 2,112,157.

The crystal structure of the present silver halide grains may be uniform, or such that the halide composition varies between the inner portion and the outer portion thereof, or may comprise a layer structure. Alternatively, silver halides having different compositions may be connected to each other by an epitaxial junction or by any suitable compound other than silver halide such as silver thiocyanate, and zinc oxide.

Alternatively, a mixture of grains having various crystal structures may be used.

The present silver halide emulsion may be normally subjected to physical ripening, chemical ripening, and spectral sensitization before use. Examples of additives to be used in such processes are described in *Research Disclosure,* Nos. 17643 and 18716. The location of these descriptions are summarized in the table below.

Examples of photographic additives which can be used in the present invention are described in these citations.

| | Additives | RD 17643 | RD 18716 |
|---|---|---|---|
| 1. | Chemical Sensitizers | Page 23 | Page 648, right column |
| 2. | Sensitivity Increasing Agents | — | Page 648, right column |
| 3. | Spectral Sensitizers, Supersensitizers | Pages 23–24 | Page 648, right column to page 649, right column |
| 4. | Brightening Agents | Page 24 | — |
| 5. | Antifoggants and Stabilizers | Pages 24–25 | Page 649, right column |
| 6. | Light Absorbers, Filter Dyes, Ultraviolet Absorbers | Pages 25–26 | Page 649, right column to page 650, left column |
| 7. | Antistaining Agents | Page 25, right column | Page 650, left to right columns |
| 8. | Dye Image Stabilizers | Page 25 | — |
| 9. | Hardeners | Page 26 | Page 651, left column |
| 10. | Binders | Page 26 | Page 651, left column |
| 11. | Plasticizers, Lubricants | Page 27 | Page 650, right column |
| 12. | Coating Aids, Surface Active Agents | Pages 26–27 | Page 650, right column |
| 13. | Antistatic Agents | Page 27 | Page 650, right column |

The present silver halide color photographic material is characterized in that it comprises a magenta coupler represented by formula (M1) for the purpose of improving the desilvering property and inhibiting bleach fog.

Among the pyrazoloazole magenta couplers represented by formula (M-1), compounds represented by formulae (M-2), (M-3), (M-4), (M-5), and (M-6) are preferred for use in the present invention

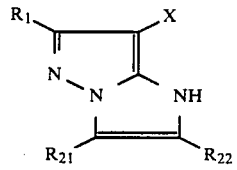
(M-2)

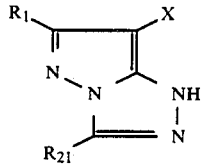
(M-3)

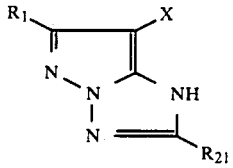
(M-4)

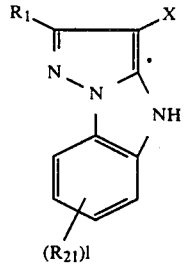
(M-5)

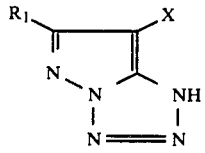
(M-6)

In formulae (M-2) to (M-6), $R_1$ and X have the same meaning as defined in formula (M-1); $R_{21}$ and $R_{22}$ have the same meaning as $R_2$ in formula (M-1); and l represents an integer of 1 to 4.

The pyrazoloazole magenta couplers of formulae (M-1) to (M-6) are further described as follows.

Examples of groups represented by $R_1$, $R_2$, $R_{21}$ and $R_{22}$ in formulae (M-1) to (M-6) include hydrogen, a halogen atom (e.g., fluorine, chlorine), an alkyl group (e.g., methyl, ethyl, isopropyl, 1-butyl, t-butyl, 1-octyl), an aryl group (e.g., phenyl, p-tolyl, 4-nitrophenyl, 4-ethoxyphenyl, 2-(2-octyloxy-5-t-octylbenzene-sulfonamido)phenyl, 3-dodecanesulfonamidophenyl, 1-naphthyl), a heterocyclic group (e.g., 4-pyridyl, 2-furyl), a hydroxyl group, an alkoxy group (e.g., methoxy, ethoxy, 1-butoxy, 2-phenoxyethoxy, 2-(2,4-di-t-amylphenoxy)ethoxy), an aryloxy group (e.g., phenoxy, 2-methoxyphenoxy, 4-methoxyphenoxy, 4-nitrophenoxy, 3-butanesulfonamidophenoxy, 2,5-di-t-amylphenoxy, 2-naphthoxy), a heterocyclic oxy group (e.g., 2-furyloxy), an acyloxy group (e.g., acetoxy, pivaloyloxy, benzoyloxy, dodecanoyloxy), an alkoxycarbonyloxy group (e.g., ethoxycarbonyloxy, t-butoxycarbonyloxy, 2-ethyl-1-hexyloxycarbonyloxy), an aryloxycarbonyloxy group (e.g., phenoxycarbonyloxy) , a carbamoyloxy group (e.g., N,N-dimethylcarbamoyloxy, N-butylcarbamoyloxy), a sulfamoyloxy group (e.g., N,N-diethylsulfamoyloxy, N-propylsulfamoyloxy), a sulfonyloxy group (e.g., methanesulfonyloxy, benzenesulfonyloxy), a carboxyl group, an acyl group (e.g., acetyl, pivaloyl, benzoyl), an alkoxycarbonyl group (e.g., ethoxycarbonyl), an aryloxycarbonyl group (e.g., phenoxycarbonyl), a carbamoyl group (e.g., N,N-dibutylcarbamoyl, N-ethyl-N-octylcarbamoyl, N-propylcarbamoyl), an amino group (e.g., amino, N-methylamino, N,N-dioctylamino), an anilino group (e.g., N-methylanilino), a heterocyclic amino group (e.g., 4-pyridylamino), an amide group (e.g., acetamide, benzamide), a urethane group (e.g., N-hexylurethane, N,N-dibutylurethane), a ureido group (e.g., N,N-dimethylureido, N-phenylureido), a sulfonamide group (e.g., butanesulfonamide, p-toluenesulfonamide), an alkylthio group (e.g., ethylthio, octylthio), an arylthio group (e.g., phenylthio, 4-dodecylphenylthio), a heterocyclic thio group (e.g., 2-benzothiazolylthio, 5-tetrazolylthio), a sulfinyl group (e.g., benzenesulfinyl), a sulfonyl group (e.g., methanesulfonyl, octanesulfonyl, p-toluenesulfonyl), a sulfo group, a cyano group, and a nitro group. Preferably, $R_1$ represents an alkyl group having from 1 to 5 carbon atoms.

X in formulae (M-1) to (M-6) represents hydrogen, a halogen atom (e.g., fluorine, chlorine, bromine), a carboxyl group, a group which is connected via an oxygen atom (e.g., acetoxy, benzoyloxy, phenoxy, 4-cyanophenoxy, tolyloxy, 4-methanesulfonylphenoxy, 4-ethoxycarbonylphenoxy, 2-naphthoxy, ethoxy, 2-cyanoethoxy, 2-benzothiazolyloxy), a group which is connected via a nitrogen atom (e.g., benzenesulfonamide, heptafluorobutanamide, pentafluorobenzamide, octanesulfonamide, p-cyanophenylureido, 1-piperidinyl, 5,5-dimethyl-2,4-dioxo-3-oxazolidinyl, 1-benzyl-5-ethoxy-3-hydantoinyl, 1-imidazolyl, 1-pyrazolyl, 3-chloro-1-pyrazolyl, 3,5-dimethyl1,1,2,4-triazole-1-yl, 5- or 6-bromobenzotriazole-1-yl) or a group which is connected via a sulfur atom (e.g., phenylthio, 2-butoxy-5-t-octylphenylthio, 4-methanesulfonylphenylthio, 4-dodecyloxyphenylthio, 2-cyanoethylthio, 1-ethoxycarbonyltridecylthio, 2-benzothiazolylthio, 1-phenyl-1,2,3,4-tetrazole5-thio). Preferably, X is a halogen atom.

Za and Zb in formula (M-1) each represents

—CH=,

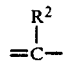

or =N—, provided that when Za=Zb is a carbon-carbon double bond, it is a portion of an aromatic ring.

Among pyrazoloazole magenta couplers represented by formulae (M-2) to (M-6), particularly preferable compounds for use in the present invention are represented by formulae (M-3) and (M-4).

Typical examples of pyrazoloazole magenta couplers represented by formulae (M-2) to (M-6) are described below, but the present invention is not limited thereto.

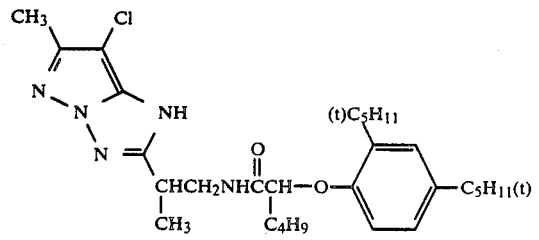

PM-1

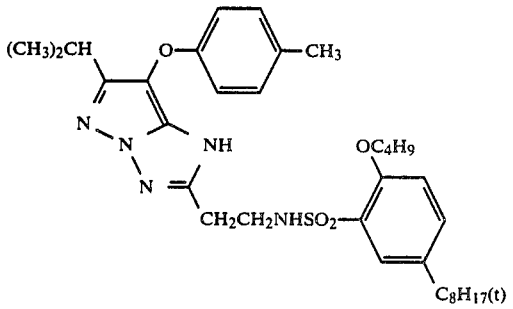

PM-2

-continued
PM-3
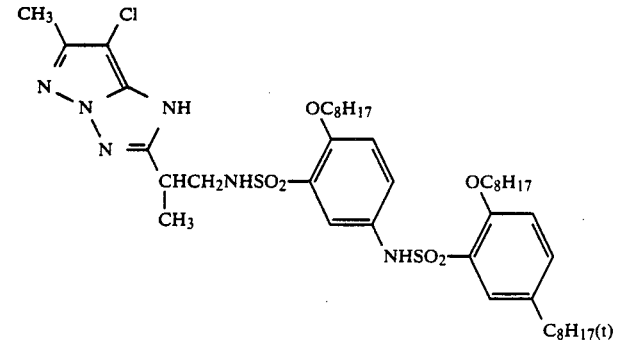
PM-4
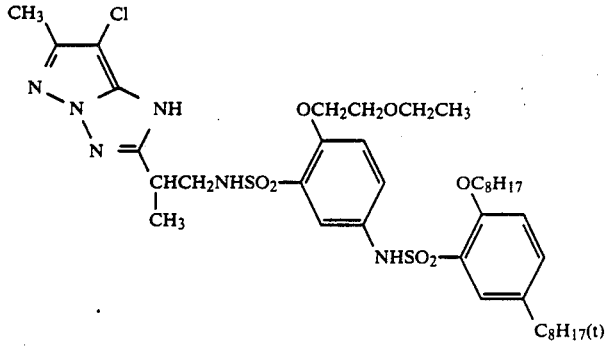
PM-5
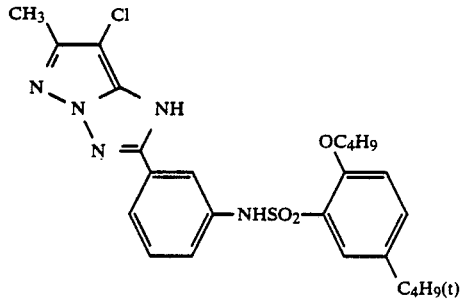
PM-6
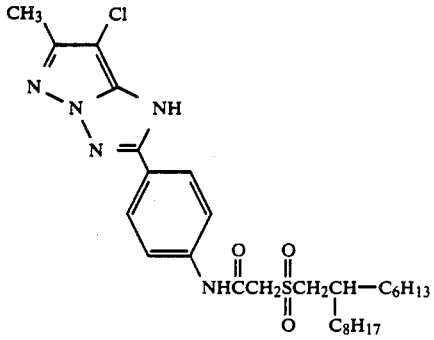
PM-7
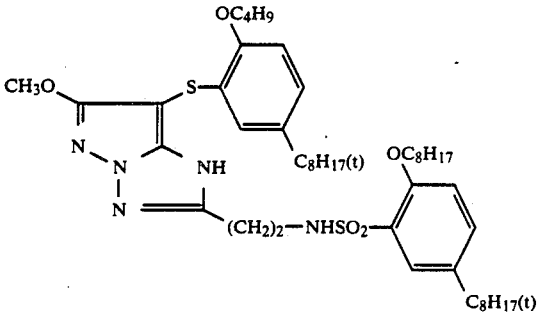

-continued
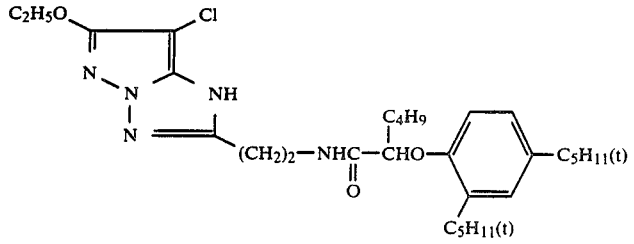
PM-8
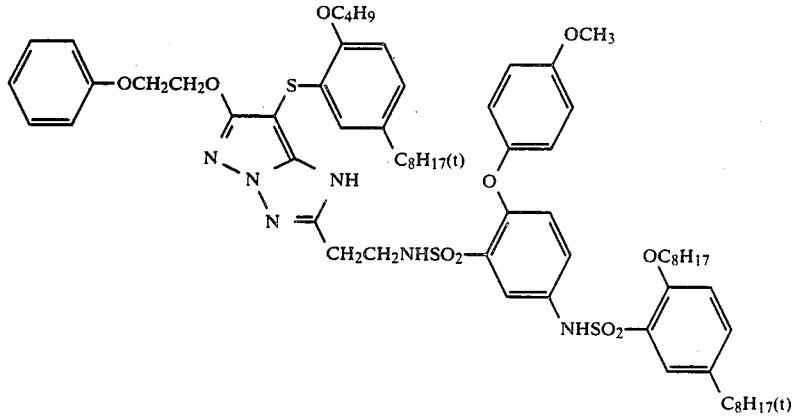
PM-9
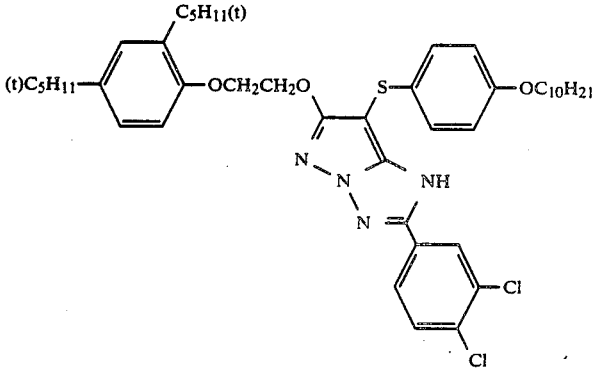
PM-10
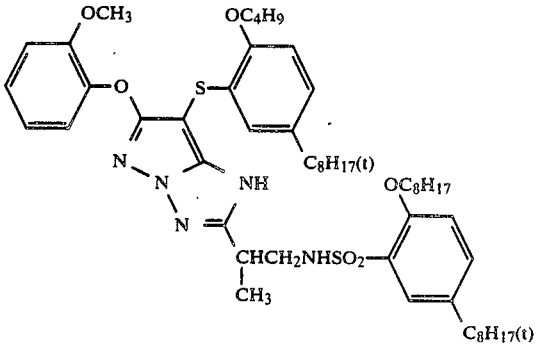
PM-11

-continued
PM-12
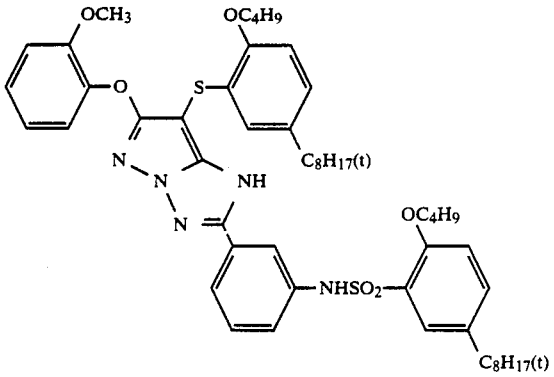
PM-13
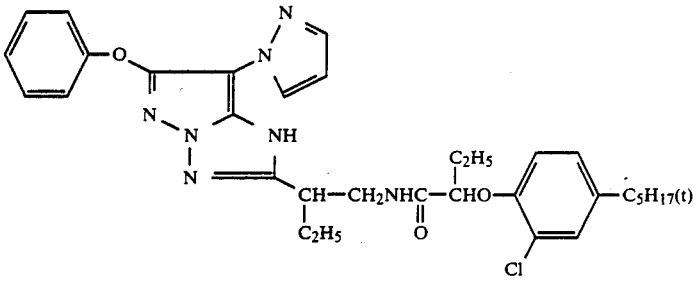
PM-14
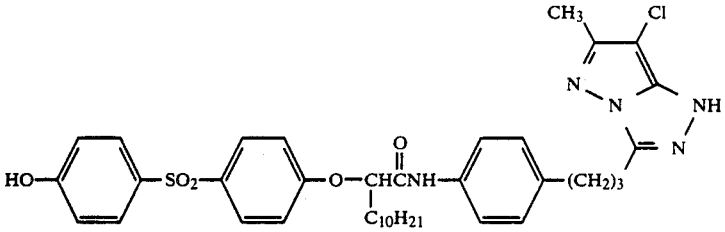
PM-15
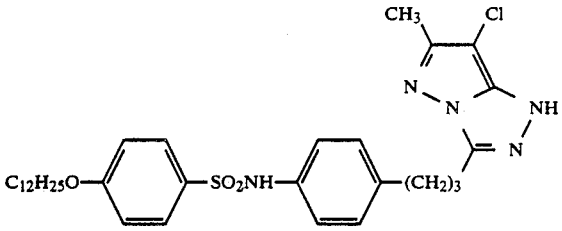
PM-16
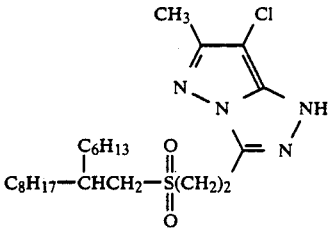
PM-17
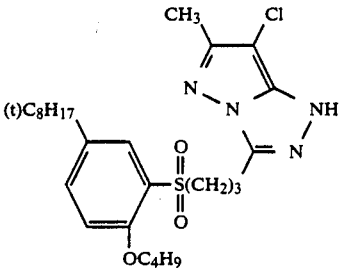

-continued
PM-18
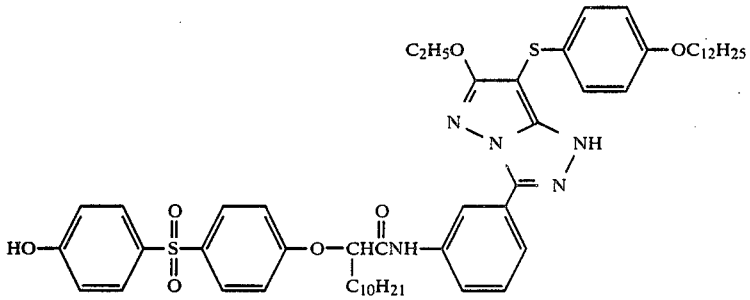
PM-19
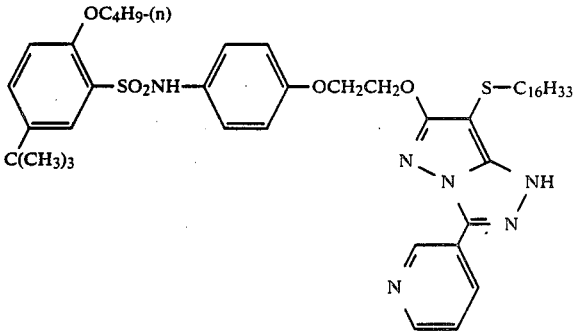
PM-20
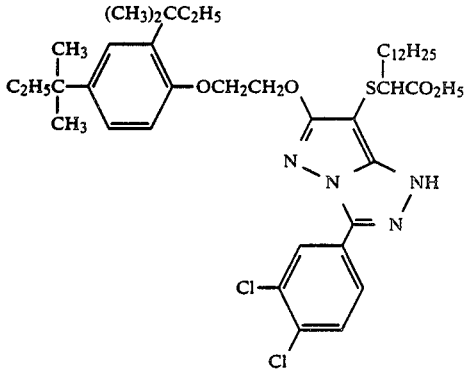
PM-21
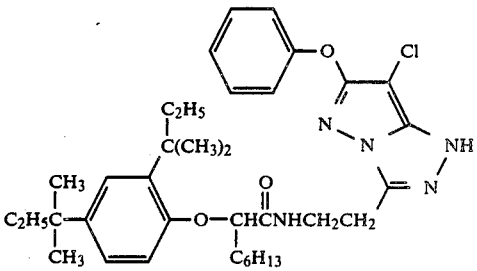
PM-22
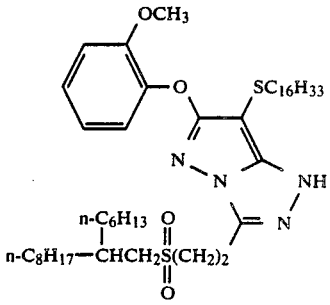

-continued

PM-23

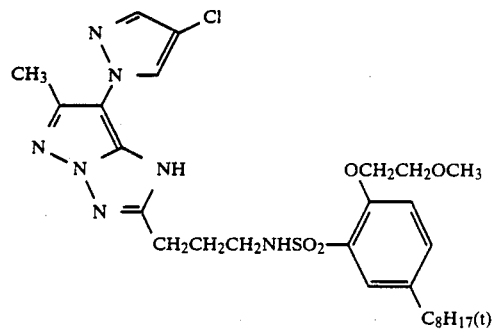

PM-24

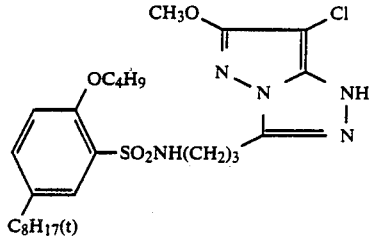

PM-25

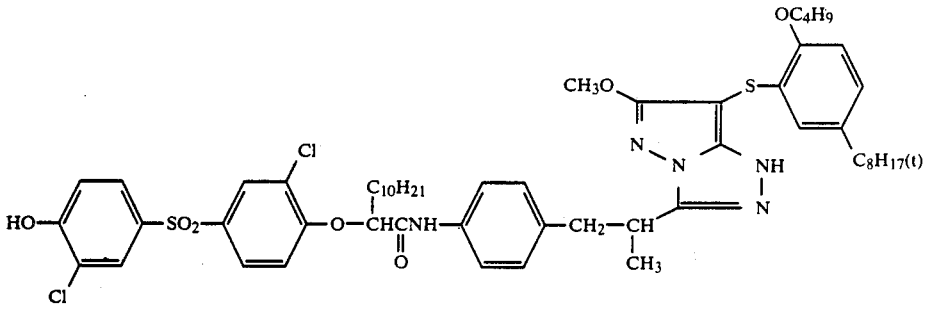

PM-26

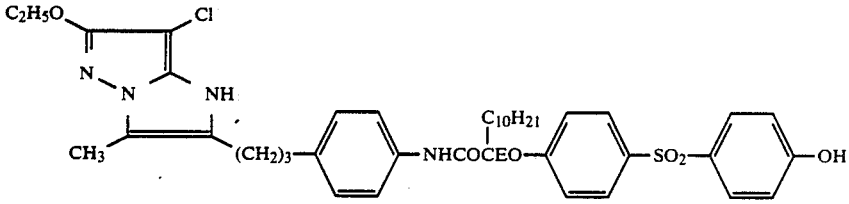

PM-27

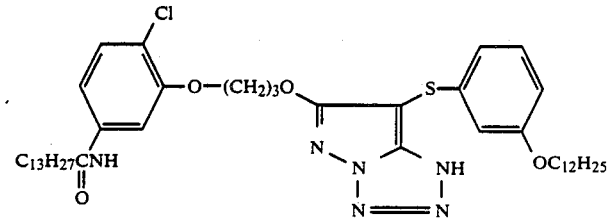

The amount of such a coupler to be incorporated in the material of the present invention is preferably in the range of from 0.01 to 20 mM (mmol), particularly 0.1 to 5 mM (mmol) per 1 $m^2$ of the light-sensitive material.

5-Pyrazolone magenta couplers or polymer couplers may be optionally used in combination with these couplers in an amount of from 0.01 to 20 mmol per 1 $m^2$ of the light-sensitive material.

Furthermore, other various couplers may be used in the present invention. Specific examples of these couplers are described in patents cited in *Research Disclosure,* No. 17643, VII-C to G.

Yellow couplers preferably used in the present invention include those described in U.S. Pat. Nos. 3,933,501, 4,022,620, 4,326,024 and 4,401,752, JP-B-58-10739, and British Patents 1,425,020 and 1,476,760.

Cyan couplers for use in the present invention include phenol and naphthol couplers as described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,451,559 and 4,427,767, West German Patent (OLS) 3,329,729, and European Patents 121365A and 161626A.

Colored couplers preferably used for eliminating undesired absorption by color dyes include those described in *Research Disclosure,* No. 17643 (VII-G), U.S. Pat. Nos. 4,163,670, 4,004,929 and 4,138,258, JP-B-57-39413 and British Patent 1,146,368.

Examples of couplers which provide a colorforming dye having proper diffusibility for use in the present invention are described in U.S. Pat. No. 4,366,237, British Patent 2,125,570, European Patent 96570, and West German Patent (OLS) 3,234,533.

Typical examples of polymerized dye-forming couplers for use in the present invention are described in U.S. Pat. Nos. 3,451,820, 4,080,211 and 4,367,282, and British Patent 2,102,173.

Couplers which release a photographically useful residual group upon coupling are preferably used in the present invention. Preferred examples of DIR couplers which release a development inhibitor are described in patents cited in *Research Disclosure,* No. 17643 (VII-F), JP-A-57-151944, JP-A-57-154234, and JP-A-60-184248, and U.S. Pat. No. 4,248,962.

Preferred examples of couplers for use in the present invention which imagewise release a nucleating agent and a development accelerator upon development are described in British Patents 2,097,140 and 2,131,188, and JP-A-59-157638 and JP-A-59-170840.

Examples of other couplers for use in the present light-sensitive material include competing couplers as described in U.S. Pat. No. 4,130,427, polyequivalent couplers as described in U.S. Pat. Nos. 4,283,472, 4,338,393 and 4,310,618, DIR redox compound-releasing couplers as described in JP-A-60-185950, and couplers which release a dye which can be recovered after elimination as described in European Patent 173302A.

The incorporation of the present couplers in the light-sensitive material can be accomplished by various dispersion methods.

Examples of high boiling solvents which can be used in an oil-in-water dispersion process are described in U.S. Pat. No. 2,322,027.

In addition, there are methods of using a polymer as coupler-dispersing medium, and various descriptions are given in JP-B-48-30494, U.S. Pat. No. 3,619,195, West German Patent 1,957,467, and JP-B-51-39835.

Specific examples of a latex dispersion method for use in the present invention and latex for use in such a dispersion method are described in U.S. Pat. No. 4,199,363 and West German Patent Applications (OLS) 2,541,274 and 2,541,230.

Examples of suitable supports which can be used in the present invention are described on page 28 of *Research Disclosure,* No. 17643 and from the right column on page 647 to the left column on page 648 in *Research Disclosure,* No. 18716.

The present invention is further described in the following examples, but the present invention is not limited thereto.

EXAMPLE 1

A Multilayer Color Light-Sensitive Material 101 was prepared by coating various layers of the following compositions on an undercoated cellulose triacetate film support.

Composition of Light-Sensitive Layers

The coated amount of each component is represented in g/m$^2$. The coated amount of silver halide is represented in terms of the amount of silver. The coated amount of sensitizing dye is represented in molar amounts per mol of silver halide incorporated in the same layer.

| | |
|---|---|
| 1st Layer: Antihalation Layer | |
| Black Colloidal Silver | 0.2 |
| Gelatin | 1.0 |
| Ultraviolet Absorber UV-1 | 0.05 |
| Ultraviolet Absorber UV-2 | 0.1 |
| Dispersing Oil OIL-1 | 0.02 |
| 2nd Layer: Interlayer | |
| Finely Divided Grains of Silver Bromide (average particle diameter: 0.07 μm) | 0.15 |
| Gelatin | 1.0 |
| 3rd Layer: 1st Red-Sensitive Emulsion Layer | |
| Monodispersed Silver Bromoiodide Emulsion (silver iodide content: 6 mol %, average particle diameter: 0.4 μm, variation coefficient: 15%) | 1.42 |
| Gelatin | 0.9 |
| Sensitizing Dye A | $2.0 \times 10^{-4}$ |
| Sensitizing Dye B | $1.0 \times 10^{-4}$ |
| Sensitizing Dye C | $0.3 \times 10^{-4}$ |
| Cp-b | 0.35 |
| Cp-c | 0.052 |
| Cp-d | 0.047 |
| D-1 | 0.023 |
| D-2 | 0.035 |
| HBS-1 | 0.10 |
| HBS-2 | 0.10 |
| 4th Layer: Interlayer | |
| Gelatin | 0.8 |
| Cpd-B | 0.10 |
| HBS-1 | 0.05 |
| 5th Layer: 2nd Red-Sensitive Emulsion Layer | |
| Monodispersed Silver Bromoiodide Emulsion (silver iodide content: 6 mol %, average particle diameter: 0.5 μm, variation coefficient: 15%) | 1.38 |
| Gelatin | 1.0 |
| Sensitizing Dye A | $1.5 \times 10^{-4}$ |
| Sensitizing Dye B | $2.0 \times 10^{-4}$ |
| Sensitizing Dye C | $0.5 \times 10^{-4}$ |
| Cp-b | 0.150 |
| Cp-d | 0.027 |
| D-1 | 0.005 |
| D-2 | 0.010 |
| HBS-1 | 0.050 |
| HBS-2 | 0.060 |
| 6th Layer: 3rd Red-Sensitive Emulsion Layer | |
| Monodispersed Silver Bromoiodide Emulsion (silver iodide content: 7 mol %, average particle diameter: 1.1 μm, variation coefficient: 16%) | 2.08 |
| Gelatin | 1.5 |
| Cp-a | 0.060 |
| Cp-c | 0.024 |
| Cp-d | 0.038 |
| D-1 | 0.006 |
| HBS-1 | 0.12 |
| 7th Layer: Interlayer | |
| Gelatin | 1.0 |
| Cpd-A | 0.05 |
| Cpd-B | 0.10 |
| HBS-2 | 0.05 |
| 8th Layer: 1st Green-Sensitive Layer | |
| Monodispersed Silver Bromoiodide Emulsion (silver iodide content: 3 mol %, average particle diameter: 0.4 μm, variation coefficient: 19%) | 0.64 |
| Monodispersed Silver Bromoiodide Emulsion (silver iodide content: 6 mol %, average particle diameter: 0.7 μm, variation coefficient: 18%) | 1.12 |
| Gelatin | 1.0 |
| Sensitizing Dye D | $1 \times 10^{-4}$ |
| Sensitizing Dye E | $4 \times 10^{-4}$ |
| Sensitizing Dye F | $1 \times 10^{-4}$ |
| Cp-h | 0.20 |
| Cp-f | 0.61 |
| Cp-g | 0.084 |
| Cp-k | 0.035 |

-continued

| | |
|---|---|
| Cp-l | 0.036 |
| D-3 | 0.041 |
| D-4 | 0.018 |
| HBS-1 | 0.25 |
| HBS-2 | 0.45 |
| 9th Layer: 2nd Green-Sensitive Emulsion Layer | |
| Monodispersed Silver Bromoiodide Emulsion (silver iodide content: 7 mol %, average particle diameter: 1.0 μm, variation coefficient: 18%) | 2.07 |
| Gelatin | 1.5 |
| Sensitizing Dye D | $1.5 \times 10^{-4}$ |
| Sensitizing Dye E | $2.3 \times 10^{-4}$ |
| Sensitizing Dye F | $1.5 \times 10^{-4}$ |
| Cp-f | 0.007 |
| Cp-h | 0.012 |
| Cp-g | 0.009 |
| HBS-2 | 0.088 |
| 10th Layer: Interlayer | |
| Yellow Colloidal Silver | 0.06 |
| Gelatin | 1.2 |
| Cpd-A | 0.3 |
| HBS-1 | 0.3 |
| 11th Layer: 1st Blue-Sensitive Emulsion Layer | |
| Monodispersed Silver Bromoiodide Emulsion (silver iodide content: 6 mol %, average particle diameter: 0.4 μm, variation coefficient: 20% | 0.31 |
| Monodispersed Silver Bromoiodide Emulsion (silver iodide content: 5 mol %, average particle diameter: 0.9 μm, variation coefficient: 17%) | 0.38 |
| Gelatin | 2.0 |
| Sensitizing Dye G | $1 \times 10^{-4}$ |
| Sensitizing Dye H | $1 \times 10^{-4}$ |
| Cp-i | 0.63 |
| Cp-j | 0.57 |

-continued

| | |
|---|---|
| D-1 | 0.020 |
| D-4 | 0.015 |
| HBS-1 | 0.05 |
| 12th Layer: 2nd Blue-Sensitive Emulsion Layer | |
| Monodispersed Silver Bromoiodide Emulsion (silver iodide content: 8 mol %, average particle diameter: 1.3 μm, variation coefficient: 18%) | 0.77 |
| Gelatin | 0.5 |
| Sensitizing Dye G | $5 \times 10^{-4}$ |
| Sensitizing Dye H | $5 \times 10^{-4}$ |
| Cp-i | 0.10 |
| Cp-j | 0.10 |
| D-4 | 0.005 |
| HBS-2 | 0.10 |
| 13th Layer: Interlayer | |
| Gelatin | 0.5 |
| Cp-m | 0.1 |
| UV-1 | 0.1 |
| UV-2 | 0.1 |
| UV-3 | 0.1 |
| HBS-1 | 0.05 |
| HBS-2 | 0.05 |
| 14th Layer: Protective Layer | |
| Monodispersed Silver Bromoiodide Emulsion (silver iodide content: 4 mol %, average particle diameter: 0.05 μm, variation coefficient: 10%) | 0.1 |
| Gelatin | 1.5 |
| Polymethyl Methacrylate Grains (average particle diameter: 1.5 μm) | 0.1 |
| S-1 | 0.2 |
| S-2 | 0.2 |

Furthermore, Surface Active Agent K-1 and Gelatin Hardener H-11 were added to the system.

Sensitizing dye A

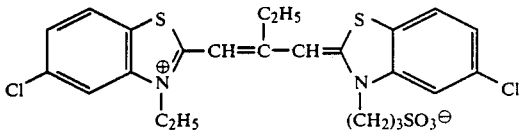

Sensitizing dye B

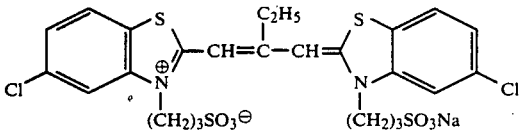

Sensitizing dye C

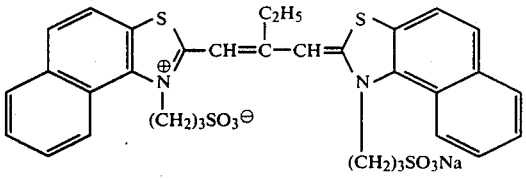

Sensitizing dye D

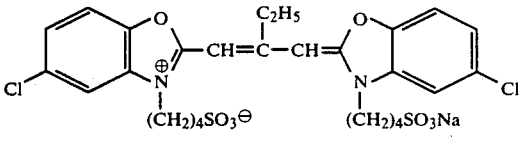

Sensitizing dye E

-continued
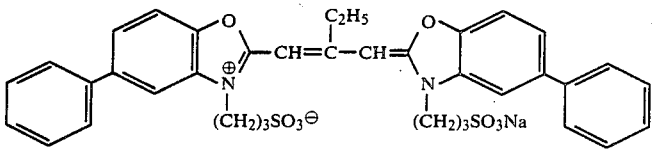
Sensitizing dye F
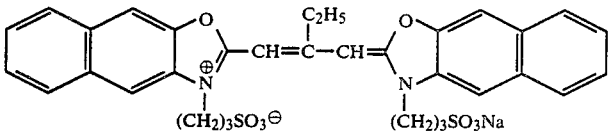
Sensitizing dye G
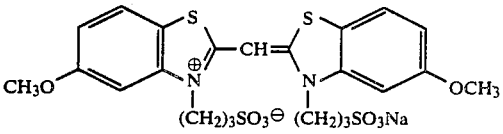
Sensitizing dye H
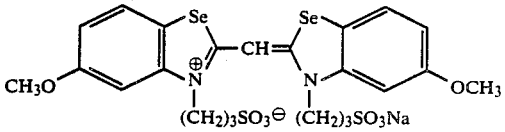
D-1
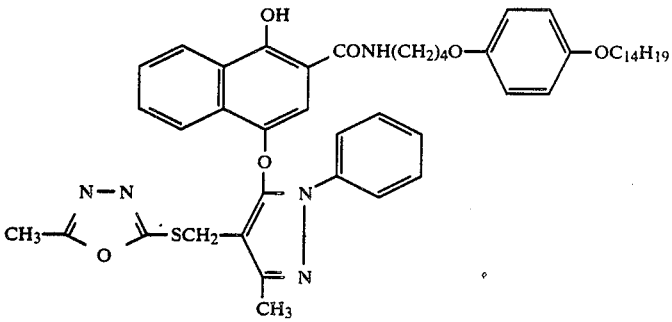
D-2
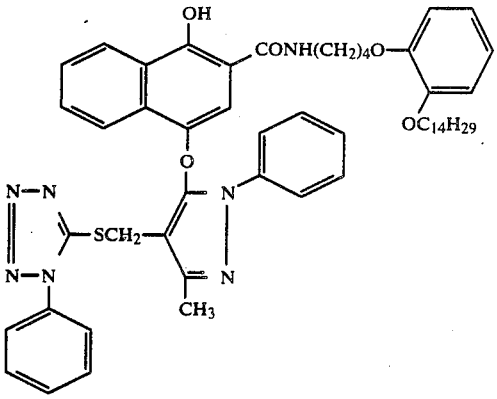

-continued
D-3
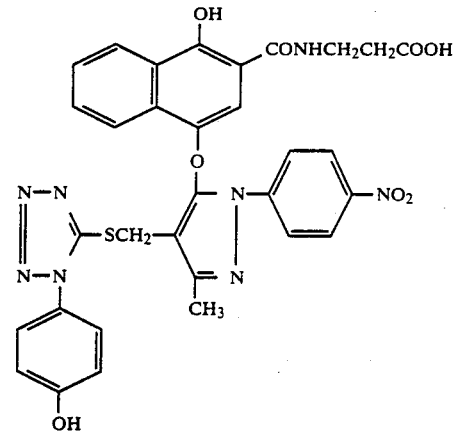
D-4
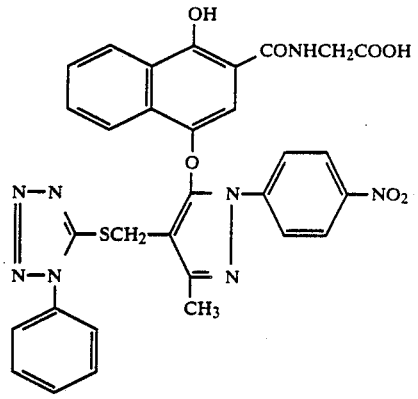
OIL-1
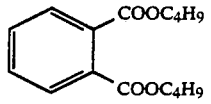
Cp-a
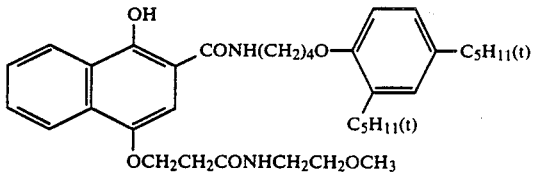
Cp-b
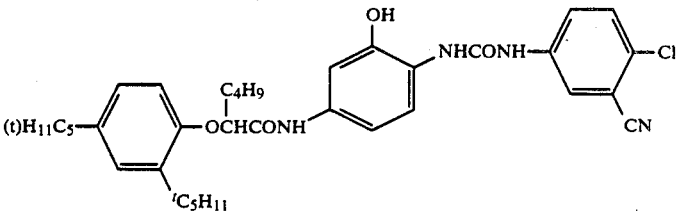

-continued
Cp-c
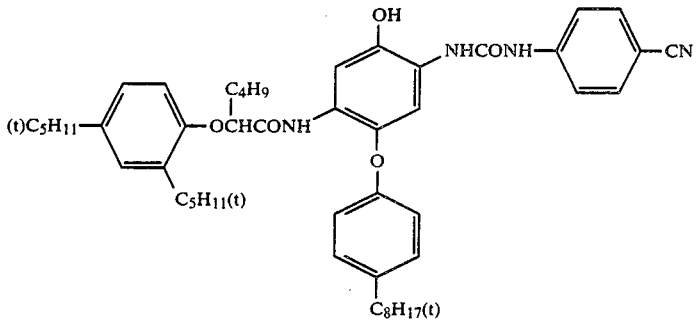
Cp-d
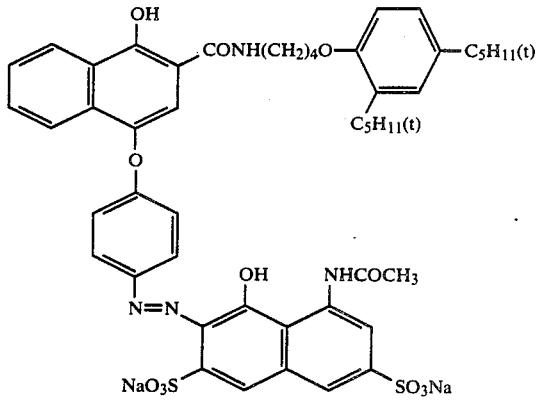
Cp-f
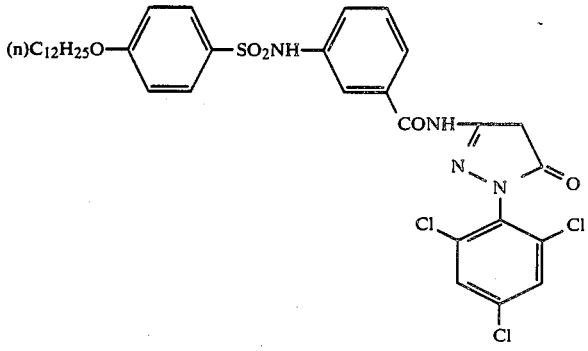
Cp-g
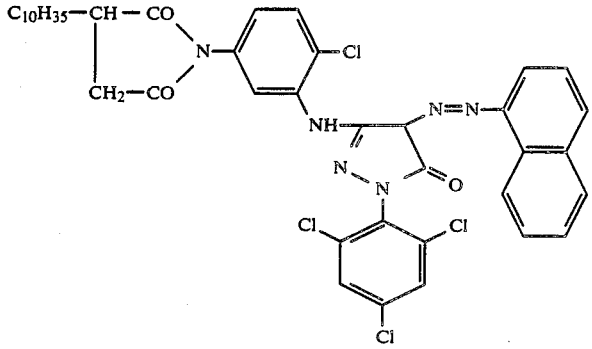

-continued
Cp-h
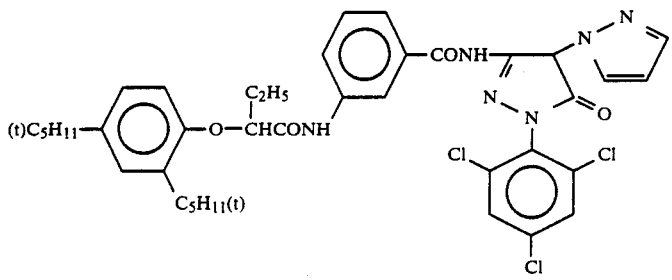
Cp-i
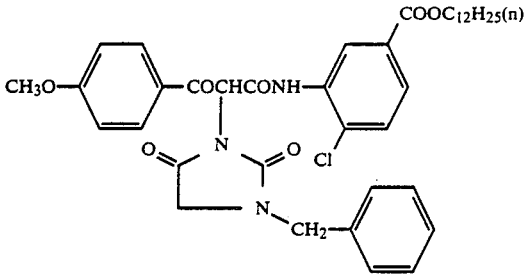
Cp-j
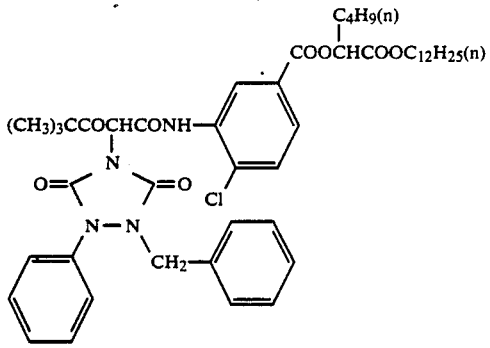
Cp-k
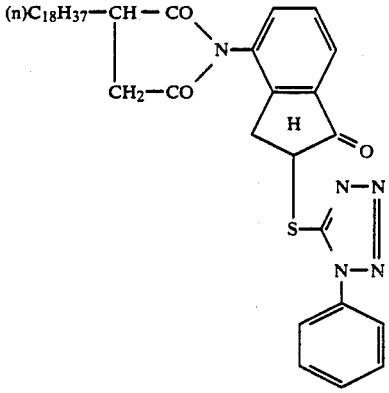
Cp-l
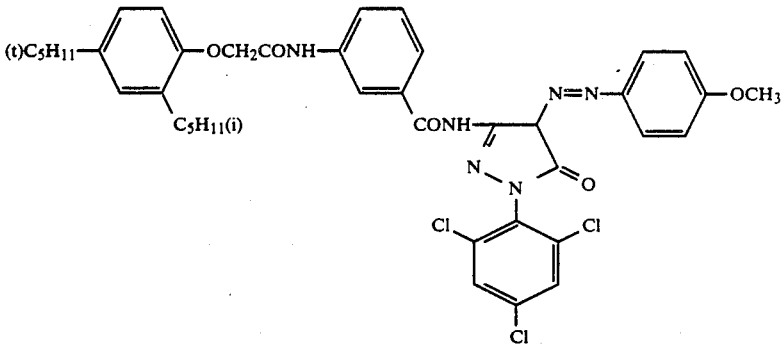

-continued
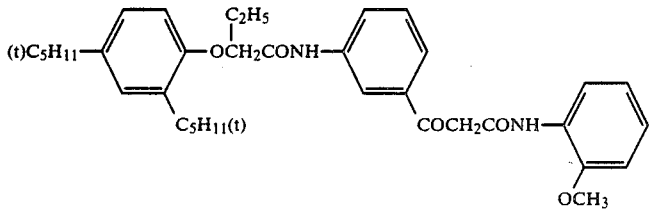
Cp-m
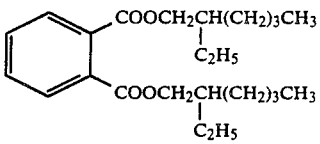
HBS-1
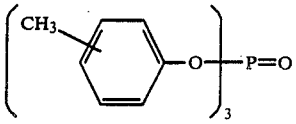
HBS-2
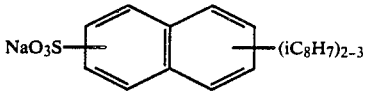
K-1
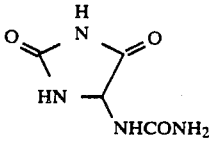
Sp-1
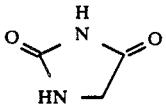
Sp-2
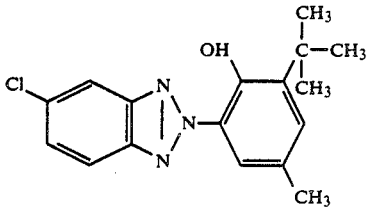
UV-1
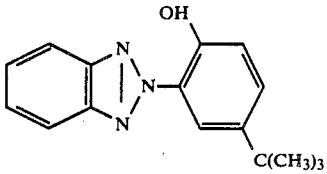
UV-2
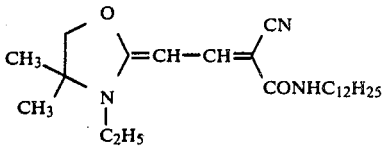
UV-3

-continued
Cpd-A
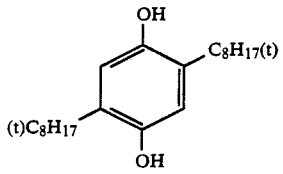
H-1
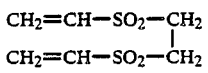
Cpd-B
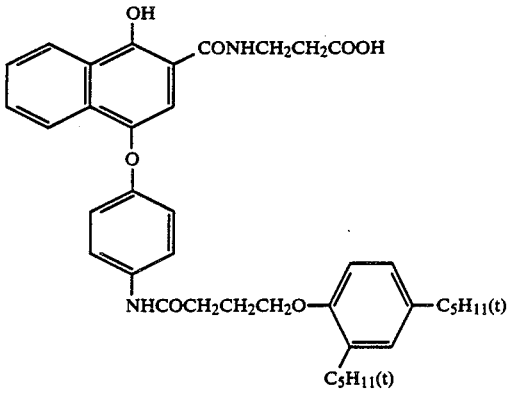
Specimens 102, 103, 104, 105 and 106 were then prepared in the same manner as in Specimen 101 except that the Magenta Coupler Cp-h was replaced by the following compounds in an equimolecular amount as Cp-h, respectively.
Specimen 104
PM-14
Specimen 105
PM-16
Specimen 102
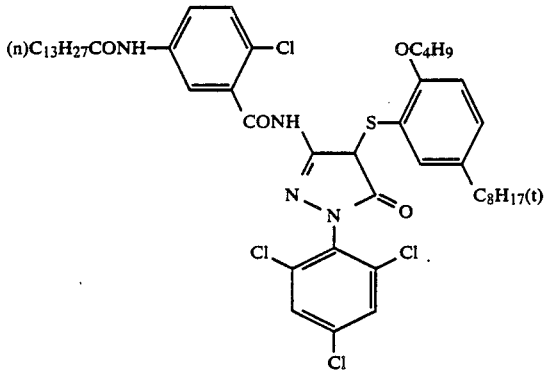
Specimen 103
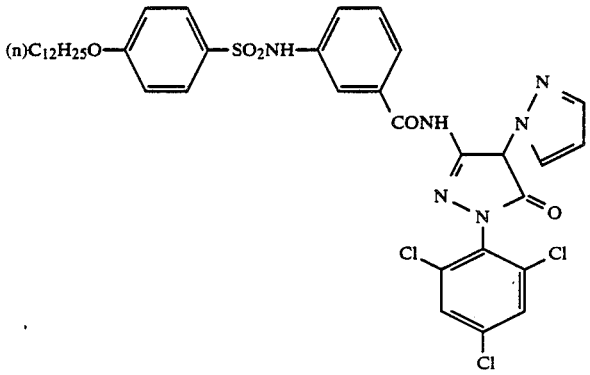

Specimen 106

PM-17

Specimen 101 thus prepared was imaqewise exposed to light and then subjected to continuous processing (running test) until the replenished color developing solution was two times the volume of the tank. The composition of the bleaching solution (bleaching agents) was altered as shown in Table 1.

A remodelled version of Fuji Color Negative Processor FP500 was used as an automatic developing machine.

The means for conveying the material comprised a belt conveyor system as described in JP-A-60-191257. Each processing bath was stirred by a jet agitation system as described in JP-A-62-183460.

Processing was carried out as follows:

| Step | Processing Time | Processing Temperature (°C.) | Replenisher per 35 mm × 1 m (ml) |
|---|---|---|---|
| Color Development | 3 min 15 sec | 38 | 38 |
| Bleaching | 1 min | 38 | 5 |
| Fixing | 1 min | 38 | 30 |
| Stabilizing 1 | 20 sec | 38 | — |
| Stabilizing 2 | 20 sec | 38 | — |
| Stabilizing 3 | 20 sec | 38 | 35 |
| Drying | 1 min 15 sec | 50–70 | — |

The stabilizing step was carried out in a three-tank countercurrent process in which the stabilizing solution flowed from tank 3 through tank 2 to tank 1.

The composition of the processing solutions used at the various processing steps are described as follows:

| | Mother Liquor (tank soln.) | Replenisher |
|---|---|---|
| Color Developing Solution: | | |
| Diethylenetriaminepentaacetic Acid | 5.0 g | 6.0 g |
| Sodium Sulfite | 4.0 g | 4.4 g |
| Potassium Carbonate | 30.0 g | 37.0 g |
| Potassium Bromide | 1.3 g | 0.9 g |
| Potassium Iodide | 1.2 mg | — |
| Hydroxylamine Sulfate | 2.0 g | 2.8 g |
| 4-[N-Ethyl-N-β-hydroxyethylamino]-2-methylaniline Sulfate | 4.7 g | 5.3 g |
| Water to make | 1.0 l | 1.0 l |
| pH | 10.00 | 10.05 |
| Bleaching Solution | | |
| Ferric Ammonium Ethylenediaminetetraacetate (dihydrate) (EDTA.Fe $NH_4$) | See Table 1 for quantities | |
| Ferric Ammonium 1,3-Diaminopropanetetraacetate (1,3-DPTA.Fe $NH_4$) | See Table 1 for quantities | |
| Bleaching Accelerator* | 4.0 g | 5.0 g |
| Ammonium Bromide | 100.0 g | 160.0 g |

-continued

| | Mother Liquor (tank soln.) | Replenisher |
|---|---|---|
| Ammonium Nitrate | 30.0 g | 50.0 g |
| Ethylenediaminetetraacetic Acid | 5.0 g | 5.0 g |
| Aqueous Ammonia (27 wt %) | 20.0 ml | 23.0 ml |
| Acetic Acid (98 wt %) | 9.0 ml | 15.0 ml |
| Water to make | 1.0 l | 1.0 l |
| pH | 4.5 | 4.5 |

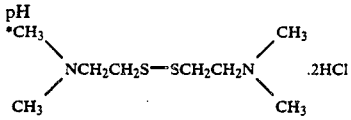

The total amount of EDTA·Fe$NH_4$ and 1,3-DTPA·Fe$NJ_4$ to be incorporated was 0.2 mol for the mother liquor and 0.3 mol for the replenisher.

| Fixing Solution: | Mother Liquor | Replenisher |
|---|---|---|
| 1-Hydroxyethylidene-1,1-diphosphonic Acid (60 wt %) | 5.0 g | 6.0 g |
| Sodium Sulfite | 7.0 g | 8.0 g |
| Sodium Bisulfite | 5.0 g | 5.5 g |
| Aqueous Solution of Ammonium Thiosulfate (700 g/liter) | 170.0 ml | 200.0 ml |
| Water to make | 1.0 l | 1.0 l |
| pH | 6.7 | 6.6 |
| Stabilizing Solution: (Mother liquor was used also as the replenisher.) | | |
| Formalin (37 wt %) | | 1.2 ml |
| 5-Chloro-2-methyl-4-isothiazoline-3-one | | 6.0 mg |
| 2-Methyl-4-isothiazoline-3-one | | 3.0 mg |
| Surface Active Agent $[C_{10}H_{21}O(CH_2CH_2O)_{10}H]$ | | 0.4 g |
| Ethylene Glycol | | 1.0 g |
| Water to make | | 1.0 liter |
| pH | | 5.0 to 7.0 |

The running processing solutions thus prepared were used to continuously process Specimens 101 to 106 which had been exposed to light with 10 CMS through an optical wedge.

The specimens thus processed were then measured by fluorescent X-ray for the amount of residual silver in the maximum density portion thereof.

The specimens were also measured for the minimum magenta density (DGmin) shortly after being processed. After being stored at a temperature of 80° C over 10 days, these specimens were again measured for the minimum magenta density to determine the increase in the maximum magenta density (ΔDGmin).

The results are shown in Table 1.

When each (running) test was completed, the bleaching solution exhibited a pH value of 4.1 to 4.2.

TABLE 1

| Process No. | Bleaching Composition EDTA.Fe$NH_4$/1,3-DPTA.Fe$NH_4$ (mol/mol) | Amount of Residual Silver (μg/cm²) | ΔDGmin After Processing | ΔDGmin After Aging | Amount of Residual Silver (μg/cm²) | ΔDGmin After Processing | ΔDGmin After Aging | Amount of Residual Silver (μg/cm²) | ΔDGmin After Processing | ΔDGmin After Aging |
|---|---|---|---|---|---|---|---|---|---|---|
| | | Specimen 101 | | | Specimen 102 | | | Specimen 103 | | |
| 1 | 10 | 38 | 0.61 | +0.13 | 37 | 0.58 | +0.14 | 37 | 0.60 | +0.15 |
| 2 | 4 | 25 | 0.65 | +0.13 | 24 | 0.65 | +0.14 | 25 | 0.66 | +0.14 |
| 3 | 3 | 10 | 0.70 | +0.12 | 10 | 0.69 | +0.13 | 9 | 0.72 | +0.13 |
| 4 | 1.5 | 7 | 0.75 | +0.12 | 7 | 0.73 | +0.13 | 7 | 0.77 | +0.13 |
| 5 | 1 | 5 | 0.79 | +0.11 | 5 | 0.77 | +0.12 | 6 | 0.81 | +0.13 |
| 6 | 0.5 | 5 | 0.81 | +0.11 | 5 | 0.79 | +0.12 | 5 | 0.84 | +0.12 |
| 7 | 0 | 5 | 0.89 | +0.10 | 5 | 0.85 | +0.12 | 5 | 0.93 | +0.12 |
| | | Specimen 104 | | | Specimen 105 | | | Specimen 106 | | |

TABLE 1-continued

| Process No. | Bleaching Composition EDTA.FeNH4/1,3-DPTA.FeNH4 (mol/mol) | Amount of Residual Silver (μg/cm²) | ΔDGmin After Processing | ΔDGmin After Aging | Amount of Residual Silver (μg/cm²) | ΔDGmin After Processing | ΔDGmin After Aging | Amount of Residual Silver (μg/cm²) | ΔDGmin After Processing | ΔDGmin After Aging |
|---|---|---|---|---|---|---|---|---|---|---|
| 1 | | 41 | 0.60 | +0.16 | 43 | 0.58 | +0.18 | 42 | 0.61 | +0.17 |
| 2 | | 30 | 0.61 | +0.13 | 29 | 0.59 | +0.16 | 30 | 0.62 | +0.14 |
| 3 | | 6 | 0.62 | +0.09 | 6 | 0.60 | +0.10 | 6 | 0.62 | +0.09 |
| 4 | | 4 | 0.62 | +0.04 | 4 | 0.61 | +0.05 | 3 | 0.62 | +0.04 |
| 5 | | 4 | 0.63 | +0.04 | 4 | 0.61 | +0.05 | 3 | 0.62 | +0.04 |
| 6 | | 4 | 0.63 | +0.04 | 4 | 0.61 | +0.05 | 3 | 0.63 | +0.04 |
| 7 | | 4 | 0.67 | +0.06 | 4 | 0.65 | +0.07 | 3 | 0.69 | +0.06 |

The figures within [ ] indicate the present invention.

The smaller the molar ratio of EDTA·FeNH4/1,3-DPTA·FeNH4 is, the less the amount of residual silver. Comparative Specimens 101, 102 and 103 each exhibited an increase in magenta stain due to bleach fog. The present specimens which had been subjected to the present processing (Nos. 3 to 7) exhibited little or no bleach fog. Furthermore, the present specimens exhibited a remarkably small magenta stain after aging. This effect becomes remarkable particularly when the ratio of EDTA·FeNH4/1,3-DPTA·FeNH4 is in the rang of 0.5 to 1.5.

EXAMPLE 2

Specimens 101 to 106 were subjected to the same running test as in Process No. 5 in Example 1 except that the bleaching accelerator was replaced by (I A)-(5), (I A)-(13), (I A)-(16), (I A)-(19), (II A)-(11), and (V A)-(1), respectively. As a result, the Present Specimens 104, 105 and 106 exhibited excellent properties as in Example 1.

EXAMPLE 3

Specimens 101 to 106 were subjected to Process No. 6 as in Example 1 except that ferric ammonium ethylenediaminetetraacetate was replaced by ferric ammonium diethylenetriaminepentaacetate in an equimolecular amount. As a result, the Present Specimens 104, 105 and 106 exhibited excellent properties as in Example 1.

EXAMPLE 4

Specimens 101 to 106 were subjected to Process No. 6 as in Example 1 except that ferric ammonium ethylenediaminetetraacetate was replaced by ferric ammonium 1,2-cyclohexanediaminetetraacetate in an equimolecular amount. As a result, the Present Specimens 104, 105 and 106 exhibited excellent properties as in Example 1.

EXAMPLE 5

Specimens 101 to 106 were subjected to Process No. 4 as in Example 1 except that ferric ammonium ethylenediaminetetraacetate was replaced by ferric ammonium 1,2-propylenediaminetetraacetate in an equimolecular amount. As a result, the Present Specimens 104, 105 and 106 exhibited excellent properties as in Example 1.

EXAMPLE 6

A Multilayer Color Light-Sensitive Material 201 was prepared as follows by coating various layers of the following compositions on an undercoated cellulose triacetate film support.

Composition of Light-Sensitive layer

The coated amount of each component is represented in g/m². The coated amount of silver halide is represented in terms of the amount of silver. The coated amount of sensitizing dye is represented in molar amount per mol of silver halide incorporated in the same layer.

| Specimen 201 | |
|---|---|
| 1st Layer: Antihalation Layer | |
| Black Colloidal Silver | 0.18 |
| Gelatin | 0.40 |
| 2nd Layer: Interlayer | |
| 2,5-Di-t-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| 3rd Layer: 1st Red-Sensitive Emulsion Layer | |
| Monodispersed Silver Bromoiodide Emulsion (silver iodide content: 6 mol %, average particle diameter: 0.6 μm, variation coefficient in particle diameter: 0.15) | 0.55 |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| Sensitizing Dye IV | $4.0 \times 10^{-5}$ |
| EX-2 | 0.350 |
| HBS-1 | 0.005 |
| EX-10 | 0.020 |
| Gelatin | 1.20 |
| 4th Layer: 2nd Red-Sensitive Emulsion Layer | |
| Monodispersed Emulsion of Tabular Silver Bromoiodide Grains (silver iodide content: 10 mol %, average particle diameter: 0.7 μm, average aspect ratio: 5.5, average thickness: 0.2 μm) | 1.0 |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| EX-2 | 0.400 |
| EX-3 | 0.050 |
| EX-10 | 0.015 |
| Gelatin | 1.30 |
| 5th Layer: 3rd Red-Sensitive Emulsion Layer | |
| Silver Bromoiodide Emulsion (silver iodide content: 16 mol %, average particle diameter: 1.1 μm) | 1.60 |
| Sensitizing Dye IX | $5.4 \times 10^{-5}$ |
| Sensitizing Dye II | $1.4 \times 10^{-5}$ |
| Sensitizing Dye III | $2.4 \times 10^{-4}$ |
| Sensitizing Dye IV | $3.1 \times 10^{-5}$ |
| EX-3 | 0.240 |
| EX-4 | 0.120 |

-continued

| Specimen 201 | |
|---|---|
| HBS-1 | 0.22 |
| HBS-2 | 0.10 |
| Gelatin | 1.63 |
| 6th Layer: Interlayer | |
| EX-5 | 0.040 |
| HBS-1 | 0.020 |
| EX-12 | 0.004 |
| Gelatin | 0.80 |
| 7th Layer: 1st Green-Sensitive Emulsion Layer | |
| Monodispersed Emulsion of Tabular Silver Bromoiodide Grains (silver iodide content: 6 mol %, average particle diameter: 0.6 μm, average aspect ratio: 6.0, average thickness: 0.15 μm) | 0.40 |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-4 | 0.010 |
| Gelatin | 0.75 |
| 8th Layer: 2nd Green-Sensitive Emulsion Layer | |
| Monodispersed Silver Bromoiodide Emulsion (silver iodide content: 9 mol %, average particle diameter: 0.7 μm, variation coefficient in particle diameter: 0.18) | 0.80 |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| EX-6 | 0.180 |
| EX-8 | 0.010 |
| EX-1 | 0.008 |
| EX-7 | 0.012 |
| HBS-1 | 0.160 |
| HBS-4 | 0.008 |
| Gelatin | 1.10 |
| 9th Layer: 3rd Green-Sensitive Emulsion Layer | |
| Silver Bromoiodide Emulsion (silver iodide content: 12 mol %, average particle diameter: 1.0 μm) | 1.2 |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| EX-6 | 0.065 |
| EX-11 | 0.030 |
| EX-1 | 0.025 |
| HBS-1 | 0.25 |
| HBS-2 | 0.10 |
| Gelatin | 1.74 |

-continued

| Specimen 201 | |
|---|---|
| 10th Layer: Yellow Filter Layer | |
| Yellow Colloidal Silver | 0.05 |
| EX-5 | 0.08 |
| HBS-3 | 0.03 |
| Gelatin | 0.95 |
| 11th Layer: 1st Blue-Sensitive Emulsion Layer | |
| Monodispersed Emulsion of Tabular Silver Bromoiodide Grains (silver iodide content: 6 mol %, average particle diameter: 0.6 μm, average aspect ratio: 5.7, average thickness: 0.15 μm) | 0.24 |
| Sensitizing Dye VIII | $3.5 \times 10^{-4}$ |
| EX-9 | 0.85 |
| EX-8 | 0.12 |
| HBS-1 | 0.28 |
| Gelatin | 1.28 |
| 12th Layer: 2nd Blue-Sensitive Emulsion Layer | |
| Monodispersed Silver Bromoiodide Emulsion (silver iodide content: 10 mol %, average particle diameter: 0.8 μm, variation coefficient in particle diameter: 0.16) | 0.45 |
| Sensitizing Dye VIII | $2.1 \times 10^{-4}$ |
| EX-9 | 0.20 |
| EX-10 | 0.015 |
| HBS-1 | 0.03 |
| Gelatin | 0.46 |
| 13th Layer: 3rd Blue-Sensitive Emulsion Layer | |
| Silver Bromoiodide Emulsion (silver iodide content: 14 mol %, average particle diameter: 1.3 μm) | 0.77 |
| Sensitizing Dye VIII | $2.2 \times 10^{-4}$ |
| EX-9 | 0.20 |
| HBS-1 | 0.07 |
| Gelatin | 0.69 |
| 14th Layer: 1st Protective Layer | |
| Silver Bromoiodide Emulsion (silver iodide content: 1 mol %, average particle diameter: 0.07 μm) | 0.5 |
| U-4 | 0.11 |
| U-5 | 0.17 |
| HBS-1 | 0.90 |
| Gelatin | 1.00 |
| 15th Layer: 2nd Protective Layer | |
| Polymethyl Acrylate Grains (diameter: about 1.5 μm) | 0.54 |
| S-1 | 0.15 |
| S-2 | 0.05 |
| Gelatin | 0.72 |

Besides the above-described components, Gelatin Hardener H-1 and a surface active agent (e.g., alkylbenzenesulfonates) were incorporated in each layer.

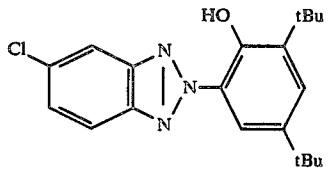

U-1

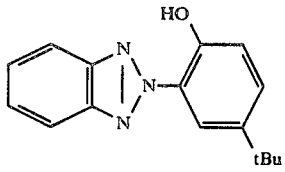

U-2

-continued
U-3
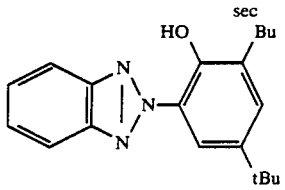
U-4
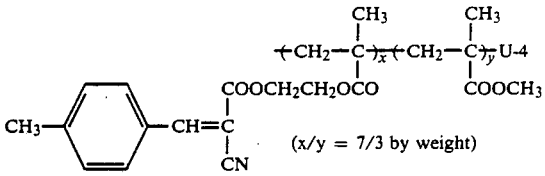
(x/y = 7/3 by weight)
U-5
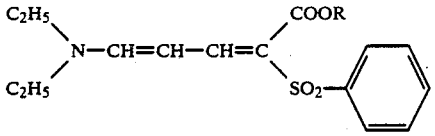
R = $C_8H_{17}$
EX-1
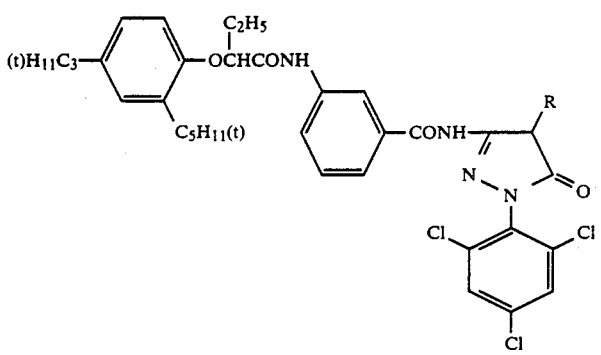
wherein R = 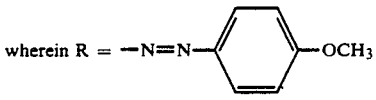
EX-2
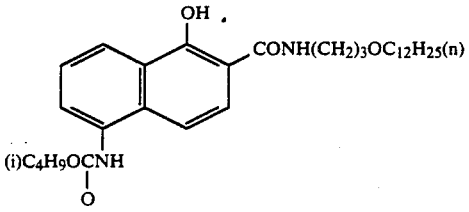
EX-3
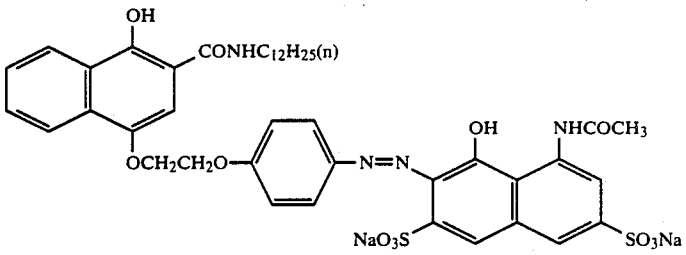
EX-4
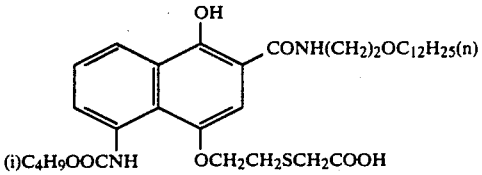

-continued
EX-5
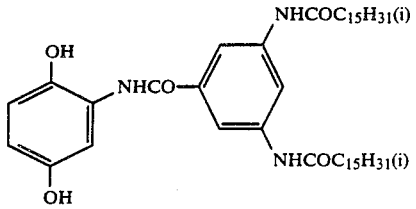
EX-6
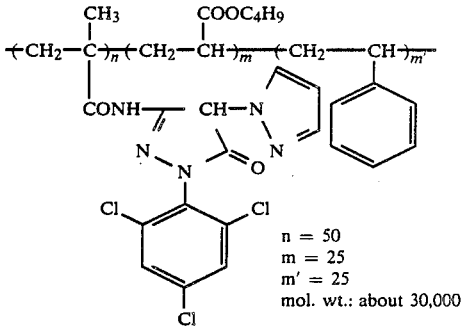
EX-7
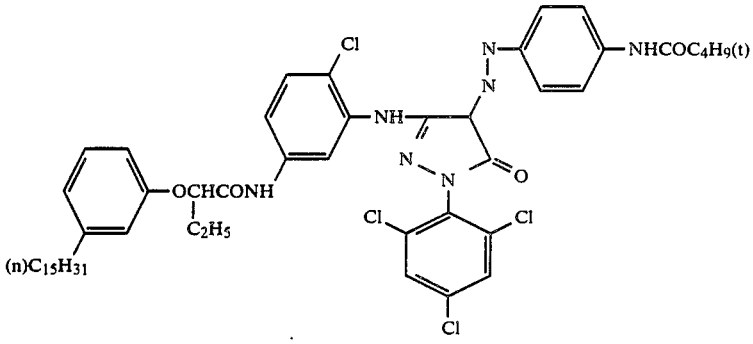
EX-8
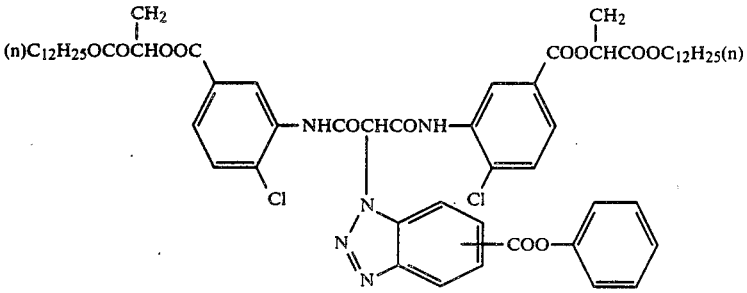
EX-9
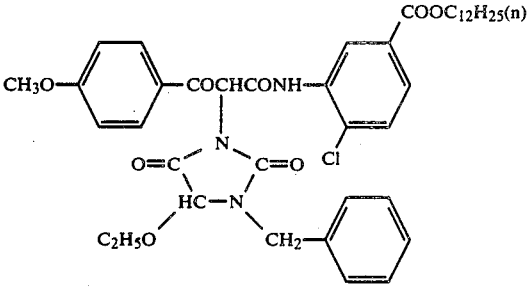

-continued
EX-10
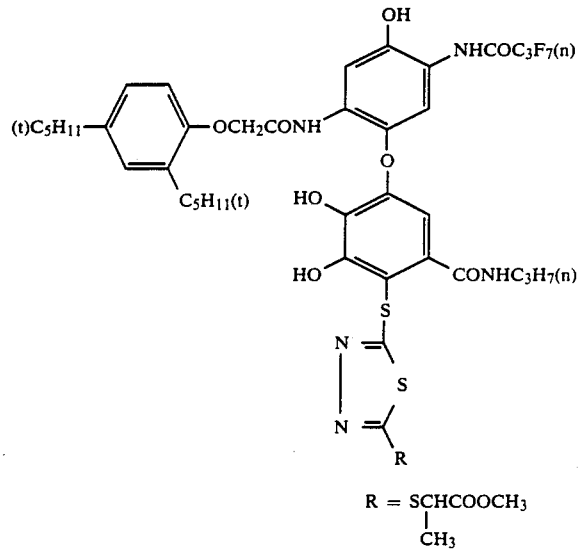
EX-11
same as EX-1 except that R = H
EX-12
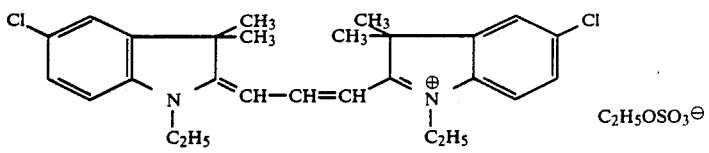
S-1
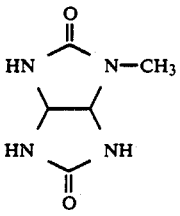
S-2
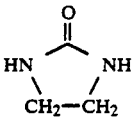
Tricresyl phosphate HBS-1
Dibutyl phthalate HBS-2
Bis(2-ethylhexyl)phthalate HBS-3
HBS-4
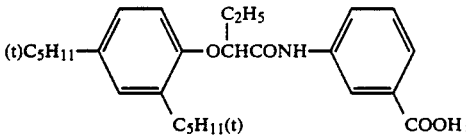
H-1
$CH_2{=}CH{-}SO_2{-}CH_2{-}CONH{-}CH_2$
$CH_2{=}CH{-}SO_2{-}CH_2{-}CONH{-}CH_2$
Sensitizing dye
I
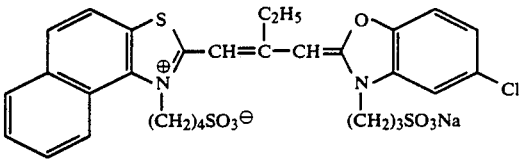

-continued

II

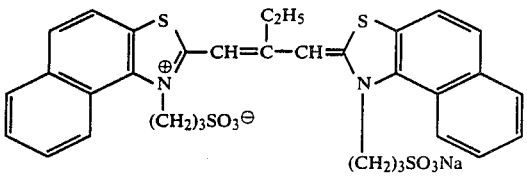

III

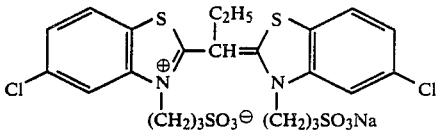

IV

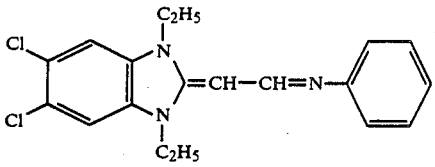

V

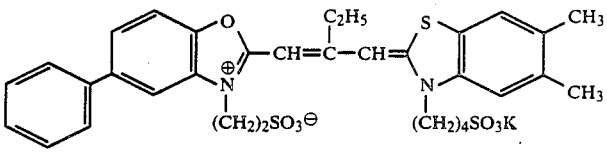

VI

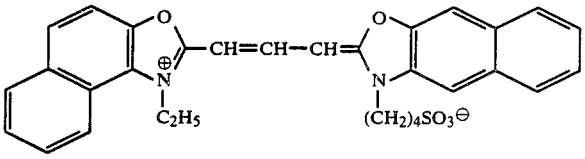

VII

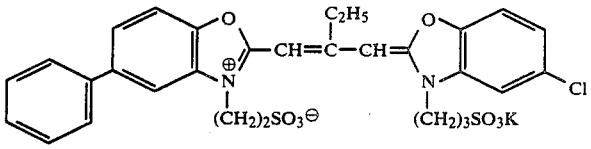

VIII

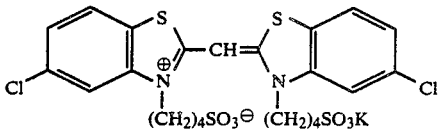

IX

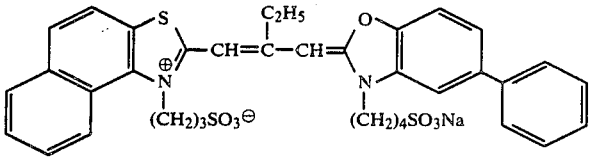

Specimens 202, 203 and 204 were then prepared in the same manner as Specimen 201 except that the Magenta Coupler EX-6 to be incorporated in the 7th to 9th layers were replaced by PM-3, PM-9 and PM-10, respectively.

Specimen 201 thus prepared was then subjected to the following running test in the same manner as in Example 1.

| Processing | Processing Temperature | Replenisher per 35 mm × |
|---|---|---|

-continued

| Step | Time | (°C.) | 1 m (ml) |
|---|---|---|---|
| Color Development | 2 min 30 sec | 40 | 40 |
| Bleaching | 30 sec | 40 | 20 |
| Blixing | 1 min | 40 | 30 |
| Washing | 1 min | 40 | 30 |
| Stabilizing | 30 sec | 40 | 30 |
| Drying | 1 min | 60 | — |

Color Developing Solution:

Same as in Example 1

-continued

| Bleaching Solution: | Tank Solution (Mother Liquor) | Replenisher |
|---|---|---|
| Ferric Ammonium Ethylenediaminetetraacetate (dihydrate) (EDTA.FeNH$_2$) Ferric Ammonium 1,3-diaminopropanetetraacetate (dihydrate) (1,3-DPTA.FeNH$_4$) | See Table 2. (The total molar amount is 0.03 mol for the tank solution and 0.04 mol for the replenisher.) The ratio of the components employed is given in Table 2. | |
| Bleaching Accelerator (same as in Example 1) | 1.5 g | 3.0 g |
| Disodium 1,3-Diaminopropanetetraacetate | 10.0 g | 10.0 g |
| Ammonium Bromide | 100.0 g | 100.0 g |
| Ammonium Nitrate | 10.0 g | 10.0 g |
| Aqueous Ammonia (27 wt %) | 15.0 ml | 10.0 ml |
| Water to make | 1.0 l | 1.0 l |
| pH | See Table 2 | |

| Blixing Solution (bleach-fixing solution): | Tank Solution | Replenisher |
|---|---|---|
| Ferric Ammonium Ethylenediaminetetraacetate (dihydrate) | 50.0 g | 70.0 g |
| Ethylenediamine-N,N,N',N'-tetramethylenephosphonic Acid | 5.0 g | 6.0 g |
| Sodium Sulfite | 12.0 g | 17.0 g |
| Aqueous Solution of Ammonium Thiosulfate (700 g/liter) | 240.0 ml | 300.0 ml |
| Aqueous Ammonia (27 wt %) | 6.0 ml | 4.0 ml |
| Water to make | 1.0 l | 1.0 l |
| pH | 7.2 | 7.0 |

Washing Solution

Tap water was passed through a mixed bed column filled with an H type strong cation exchange resin (Rohm & Haas, Amberlite IR-120B) and an OH type anion exchange resin (Amberlite IR-400) such that the calcium and magnesium concentration was each adjusted to 3 mg/liter or less. Sodium dichloroisocyanate and sodium sulfate were then added to the solution in amounts of 20 mg/liter and 0.15 g/liter, respectively.

The rinsing solution thus prepared exhibited a pH value of 6.5 to 7.5.

| Stabilizing Solution: | |
|---|---|
| Formalin (37 wt %) | 2.0 ml |
| Polyoxyethylene-p-monononylphenylether (average polymerization degree: 10) | 0.3 g |
| Disodium Ethylenediaminetetraacetate | 0.3 g |
| Water to make | 1.0 liter |
| pH | 5.0 to 8.0 |

Specimens 201 to 204 which had been exposed to light through an optical wedge were processed with each running test solution, and then measured for the amount of residual silver and magenta stain in the same manner as in Example 1. The results are shown in Table 2.

TABLE 2

| Process No. | Bleaching Composition EDTA.FeNH$_4$/1,3-DPTA.FeNH$_4$ | Bleaching Solution pH: Tank Solution | Replenisher | Running Solution | Specimen 201: Amount of Residual Silver (μg/cm$^2$) | ΔDGmin After Processing | After Aging |
|---|---|---|---|---|---|---|---|
| 1 | 4.0 | 5.5 | 5.0 | 5.5 | 30 | 0.51 | +0.14 |
| 2 | 4.0 | 4.0 | 3.5 | 4.0 | 25 | 0.50 | +0.12 |
| 3 | 1.2 | 6.0 | 5.5 | 6.0 | 13 | 0.60 | +0.13 |
| 4 | 1.2 | 5.5 | 5.0 | 5.5 | 9 | 0.59 | +0.12 |
| 5 | 1.2 | 5.0 | 4.5 | 5.0 | 8 | 0.58 | +0.11 |
| 6 | 1.2 | 4.0 | 3.5 | 4.0 | 7 | 0.56 | +0.10 |
| 7 | 1.2 | 3.0 | 2.5 | 3.0 | 6 | 0.56 | +0.09 |
| 8 | 1.2 | 1.5 | 1.0 | 1.5 | 5 | 0.65 | +0.08 |

| Process No. | Specimen 202: Amount of Residual Silver (μg/cm$^2$) | ΔDGmin After Processing | After Aging | Specimen 203: Amount of Residual Silver (μg/cm$^2$) | ΔDGmin After Processing | After Aging | Specimen 204: Amount of Residual Silver (μg/cm$^2$) | ΔDGmin After Processing | After Aging |
|---|---|---|---|---|---|---|---|---|---|
| 1 | 31 | 0.53 | +0.16 | 32 | 0.54 | +0.16 | 34 | 0.54 | +0.18 |
| 2 | 26 | 0.53 | +0.14 | 27 | 0.55 | +0.15 | 28 | 0.55 | +0.18 |
| 3 | 12 | 0.54 | +0.10 | 11 | 0.54 | +0.09 | 11 | 0.54 | +0.10 |
| 4 | 7 | 0.53 | +0.07 | 6 | 0.54 | +0.06 | 7 | 0.54 | +0.07 |
| 5 | 4 | 0.53 | +0.04 | 3 | 0.52 | +0.04 | 3 | 0.52 | +0.05 |
| 6 | 3 | 0.52 | +0.03 | 3 | 0.51 | +0.03 | 3 | 0.51 | +0.03 |
| 7 | 3 | 0.53 | +0.04 | 3 | 0.52 | +0.04 | 3 | 0.52 | +0.04 |
| 8 | 3 | 0.56 | +0.07 | 3 | 0.54 | +0.07 | 3 | 0.54 | +0.07 |

The figures within [ ] indicate the present invention.

In accordance with the present invention, the amount of residual silver is reduced, and fog and magenta stain due to aging after processing is prevented. In Table 2, processing condition including Processing Nos. 4 to 8 wherein the pH value is in the range of from 1.5 to 5.5 is preferred, and particularly processing condition including Process Nos. 5, 6 and 7 wherein the pH value is in the range of from 3 to 5.0 is most preferred in view of occurrence of fog and magenta stain due to aging after processing.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material which comprises color-developing a silver halide color photographic material which has been imagewise exposed to light, and then processing said silver halide color photographic material with a processing solution having a bleaching ability, wherein said silver halide color photographic material comprises at least one magenta coupler represented by formula (M-1) and said processing solution having a bleaching ability has a pH of from 2 to 5.3 and comprises, as a bleaching agent (1) at least one ferric complex salts of compounds selected from Compound Group (A) and (2) a ferric 1,3-diaminopropanetetraacetate complex salt in a molar proportion of the ferric complex salts (1) to the ferric 1,3-diaminopropanetetraacetate complex salt (2) of 3 or less:

Compound Group (A)

A-1: Ethylenediaminetetraacetic acid

A-2: Diethylenetriaminepentaacetic acid

A-3: Cyclohexanediaminetetraacetic acid

A-4: 1,2-Propylenediaminetetraacetic acid

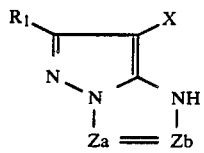

(M-1)

wherein Za and Zb each represents —CH=,

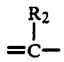

or =N—; $R_1$ and $R_2$ each represents a hydrogen atom or a substituent; and X represents a hydrogen atom or a group which is released upon a coupling reaction with an oxidation product of an aromatic primary amine developing agent, with the proviso that when Za=Zb is a carbon-carbon double bond, Za=Zb is a portion of an aromatic ring.

2. The method for processing a silver halide color photographic material as in claim 1, wherein said molar proportion of the ferric complex salts (1) to the ferric 1,3-diaminopropanetetraacetate complex salt (2) is from 0.5 to 1.8.

3. The method for processing a silver halide color photographic material as in claim 1, wherein the amount of said bleaching agent present in said processing solution having a bleaching ability is from 0.05 to 1 mol per liter of the processing solution.

4. The method for processing a silver halide color photographic material as in claim 1, wherein said processing solution having a bleaching ability further comprises a bleaching accelerator.

5. The method for processing a silver halide color photographic material as in claim 4, wherein the amount of said bleaching accelerator is from 0.01 to 20 g per liter of said processing solution having a bleaching ability.

6. The method for processing a silver halide color photographic material as in claim 1, wherein the amount of said magenta coupler represented by formula (M-1) present in said silver halide color photographic material is from 0.01 to 20 mM per 1 $m^2$ of the material.

7. The method for processing a silver halide color photographic material as in claim 1, wherein said processing solution having a bleaching ability is a bleaching solution.

8. The method for processing a silver halide color photographic material as in claim 1, wherein said magenta coupler represented by formula (M-1) is a magenta coupler represented by formula (M-2), (M-3), (M-4), (M-5) or (M-6):

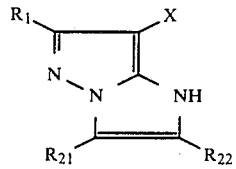

(M-2)

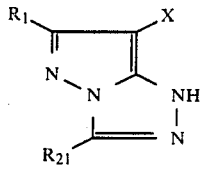

(M-3)

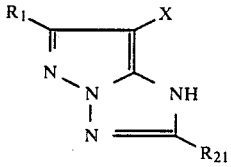

(M-4)

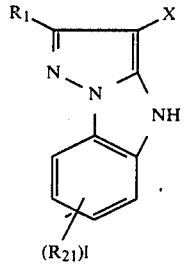

(M-5)

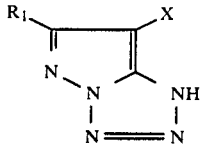

(M-6)

wherein $R_1$, $R_{21}$ and $R_{22}$ each represents a hydrogen atom or a substituent; X represents a hydrogen atom or a group which is released upon a coupling reaction with an oxidation product of an aromatic primary amine developing agent, and l represents an integer of 1 to 4.

9. The method for processing a silver halide color photographic material as in claim 1, wherein said silver halide color photographic material comprises a photographic emulsion layer containing silver bromoiodide having a silver iodide content of from about 1 to about 20 mol%.

* * * * *